US011754360B2

(12) United States Patent
Anderson

(10) Patent No.: US 11,754,360 B2
(45) Date of Patent: Sep. 12, 2023

(54) TRIGGER ASSEMBLY GROUP AND METHODS OF USE

(71) Applicant: John Carnan Anderson, Uvalde, TX (US)

(72) Inventor: John Carnan Anderson, Uvalde, TX (US)

( * ) Notice: Subject to any disclaimer, the term of this patent is extended or adjusted under 35 U.S.C. 154(b) by 0 days.

(21) Appl. No.: 17/932,064

(22) Filed: Sep. 14, 2022

(65) Prior Publication Data

US 2023/0080197 A1 Mar. 16, 2023

Related U.S. Application Data

(60) Provisional application No. 63/261,166, filed on Sep. 14, 2021.

(51) Int. Cl.

| | |
|---|---|
| ***F41A 19/10*** | (2006.01) |
| ***F41A 19/45*** | (2006.01) |
| ***F41A 17/46*** | (2006.01) |
| ***F41A 19/12*** | (2006.01) |
| ***F41A 17/82*** | (2006.01) |

(52) U.S. Cl.

CPC ..... *F41A 19/45* (2013.01); *F41A 17/46* (2013.01); *F41A 17/82* (2013.01); *F41A 19/10* (2013.01); *F41A 19/12* (2013.01)

(58) Field of Classification Search

CPC ..... F41A 19/10; F41A 17/46; F41A 19/17

USPC ..... 42/69.01, 69.02

See application file for complete search history.

(56) References Cited

U.S. PATENT DOCUMENTS

| | | | | |
|---|---|---|---|---|
| 9,335,110 | B1 * | 5/2016 | Heizer | F41A 19/38 |
| 10,801,794 | B2 | 10/2020 | Geissele | |
| 11,274,894 | B1 | 3/2022 | Hill et al. | |

* cited by examiner

*Primary Examiner* — Reginald S Tillman, Jr.

(74) *Attorney, Agent, or Firm* — Sarah Hegi Simpson; Simpson Law

(57) ABSTRACT

A trigger assembly group for use in firearms is disclosed. The trigger assembly group comprises a primary trigger connected to a secondary trigger that is arranged and configured to reduce the incidence of accidental discharge caused by inadvertently rearwardly actuating a primary trigger. The disclosed primary trigger and secondary trigger are arranged and configured for linear movement within a housing. The secondary trigger includes locking wing members that move from engagement with upper locking housing grooves to lower housing grooves. The disclosed trigger assembly group further includes a trigger shoe connected to the primary trigger, wherein the trigger shoe comprises a channel formed therein. A lower portion of the secondary trigger is configured to move from a forwardmost position, extending outwardly from the front face of the trigger shoe, to a rearmost position in which the lower portion of the secondary trigger recedes into the channel of the trigger shoe.

24 Claims, 31 Drawing Sheets

TRIGGER ASSEMBLY GROUP AND METHODS OF USE

CROSS-REFERENCE TO RELATED APPLICATIONS

This application is related to and claims priority from earlier filed U.S. Provisional Patent Application No. 63/261,166, filed Sep. 14, 2021, the disclosure of which is incorporated herein by reference.

BACKGROUND OF THE INVENTION

1. Field of the Invention

The present invention generally relates to the field of firearms, and more specifically to trigger assembly groups for firearms such as AR-15 style rifles.

2. Description of Related Art

AR-15 style rifles and their variants are widely available and in use. These firearms, like other types of firearms, have the potential to unintentionally discharge—creating a hazard to the operator of the firearm as well as to others.

Rearward movement (i.e., unintentional pulling) of a trigger is a common cause of inadvertent discharge of a firearm. Many design strategies have been employed to mitigate this issue, such as trigger guards, safety devices that require the grip of the firearm to be engaged before the trigger can be pulled, and triggers that incorporate a secondary trigger arranged and configured to block rearward pivot of a primary trigger. Design problems with current systems and methods for preventing accidental discharge of a firearm, however, present several disadvantages that are overcome by the present invention.

A need exists in the art for a trigger assembly group which prevents accidental discharge of a firearm, such as AR-15 style rifles. It is a purpose of this invention to fulfill this and other needs in the art which will become more apparent to the skilled artisan once given the following disclosure.

OBJECTS AND SUMMARY OF THE INVENTION

It is an object of the present invention to overcome the drawbacks associated with current trigger assembly groups and methods of use. To achieve these and other advantages and in accordance with the purpose of the invention, as embodied and broadly described, the present disclosure describes a trigger assembly group capable of being incorporated into a lower receiver, such as a lower receiver dimensionally common to AR-15 style rifles. The disclosed trigger assembly group includes a primary trigger with an integral secondary trigger that is arranged and configured to reduce the incidence of accidental discharge caused by inadvertently actuating the primary trigger by moving the primary trigger rearwardly. Additionally, the disclosed trigger assembly group is arranged and configured to eliminate "trigger slap" from the secondary trigger.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate exemplary embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

Figure 1:
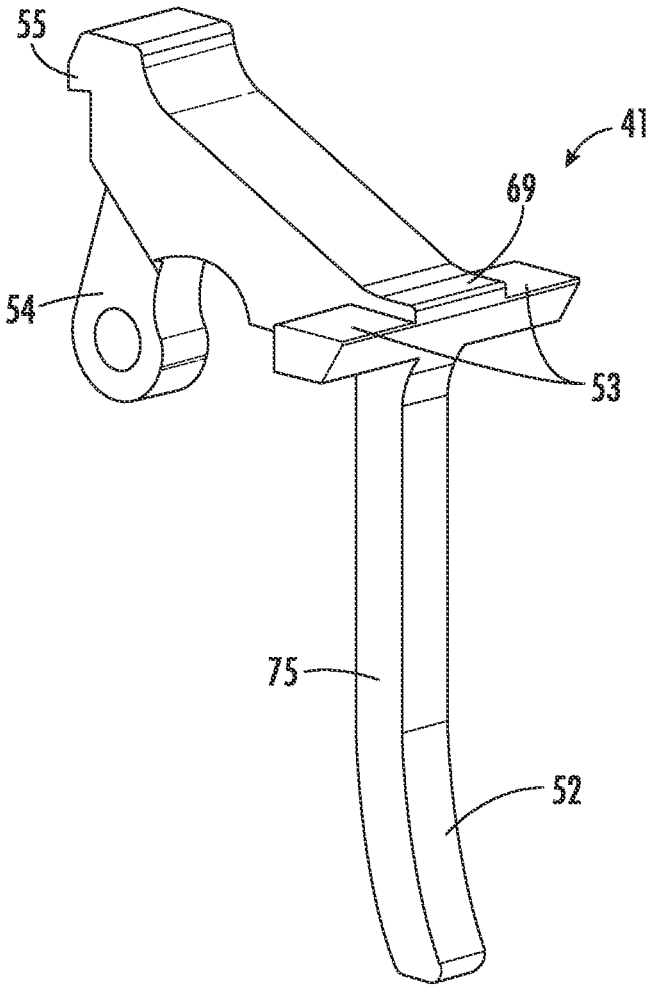
FIG. 1 is a front side perspective view of a secondary trigger arranged and configured in accordance with the teachings of the present disclosure.

Exemplary embodiments of a trigger assembly group and methods of use in accordance with the present disclosure are discussed below. Many other uses of the present invention will become obvious to one skilled in the art upon acquiring a thorough understanding of the present invention. Once given the below disclosures, many other features, modifications, and variations will become apparent to the skilled artisan in view of the teachings set forth herein. Such other features, modifications and variations are, therefore, considered to be a part of this invention.

A trigger assembly group 40 according to the present disclosure comprises a housing 46, a primary trigger 44 connected to the housing, a trigger shoe 45 connected to the primary trigger, a secondary trigger 41 connected to said housing and to said primary trigger, and a hammer 43 connected to said housing. The disclosed trigger assembly group 40 is configured for installation into a lower receiver 47 of a firearm, such as a semi-automatic firearm with a hammer-fired mechanism (e.g., an AR-15 rifle).

Starting with FIG. 1, an exemplary secondary trigger 41 is depicted. The depicted secondary trigger 41 includes a disconnector head 55, the disconnector head 55 being arranged and configured for temporarily engaging and then disengaging a front hammer hook member 60 when the firearm cycles. The depicted secondary trigger 41 further includes a secondary trigger connecting member 54 which may include an aperture for receiving a retaining pin that connects the secondary trigger 41 to a primary trigger 44 and housing 46. The secondary trigger 41 further includes a front face 52 of the lower portion 75 of the secondary trigger 41, which front face 52 of the lower portion of the secondary trigger is arranged and configured for engagement and pulling of the secondary trigger 41 by a user's finger. The depicted secondary trigger 41 includes locking wing members 53 which are arranged and configured for moving from engagement with upper locking housing grooves 71 to engagement with lower housing grooves 65 underneath the shoulders 72 of the housing 46. Furthermore, the secondary trigger 41 includes an unlocking protrusion 69 that interacts with a forward hammer unlocking protrusion 66 to move the locking wing members 53 from engagement with the upper locking housing grooves 71 to engagement with the lower housing grooves 65. A secondary trigger resilient member 51 (e.g., a compression spring) may further be included. As will be appreciated by those skilled in the art, the parts of the secondary trigger may be formed as a single integral unit or as separate connected elements. Specifically, the disconnector head may be a separate element that connects to the lower portion 75 of the secondary trigger.

Turning to FIGS. 11-16 and 18-20, a housing 46 of the trigger assembly group 40 is depicted. The housing 46 may comprise retaining pin apertures 64 for receiving retaining pins 63, wherein the depicted retaining pin apertures 64 are configured to allow for linear movement of retaining pins 63 in the retaining pin apertures 64, which therefore allows for linear movement of the primary trigger and the secondary trigger in the housing 46. The housing 46 may further include upper locking housing grooves 71 for engagement with the locking the wing members 53 of the secondary trigger, shoulders 72 for engagement of the locking the wing members 53 against the shoulders 72, and lower housing grooves 65 underneath the shoulders 72 of the housing 46. The housing may also include trigger pack retaining bolt holes 68 for receiving retaining bolts to install the trigger assembly group into a lower receiver 47.

Figure 9:
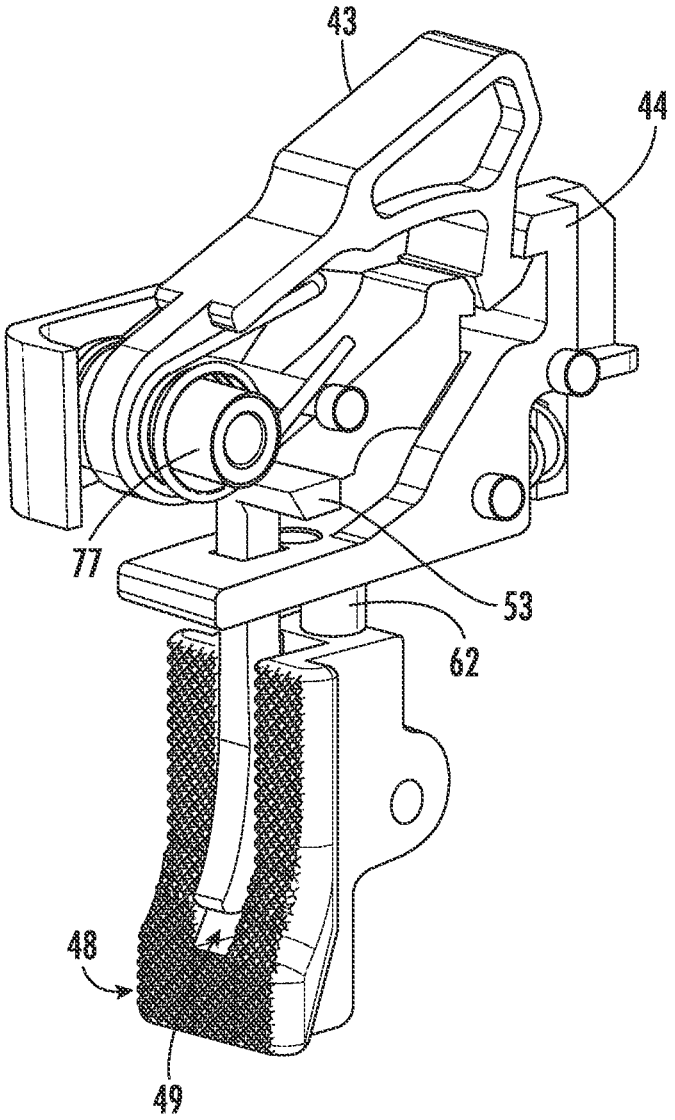
FIG. 9 is a front side perspective view of a trigger assembly group arranged and configured in accordance with the teachings of the present disclosure.
Figure 10:
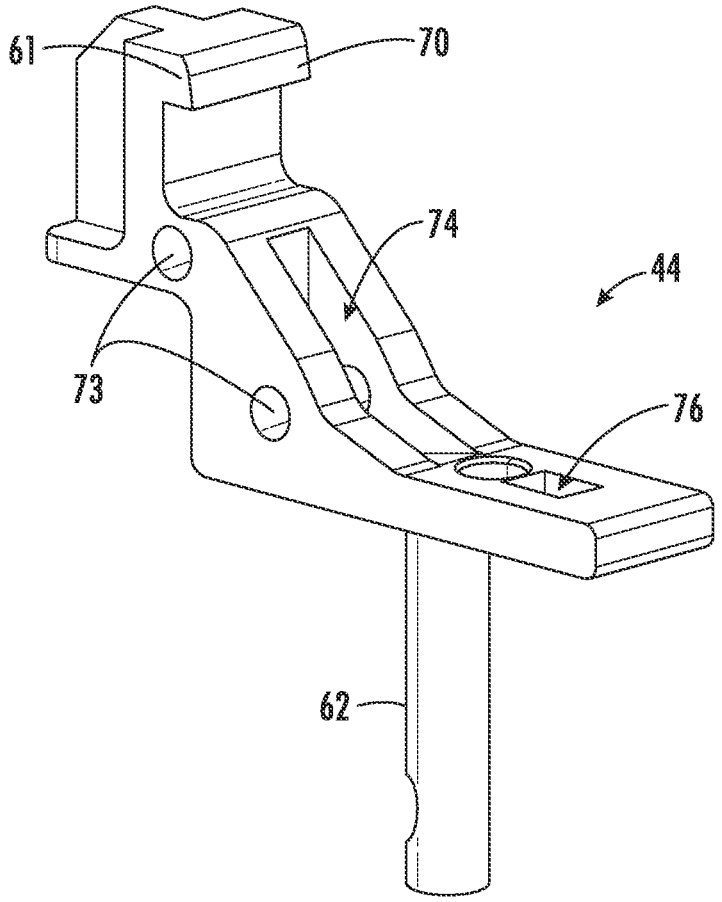
FIG. 10 is front side perspective view of a primary trigger arranged and configured in accordance with the teachings of the present disclosure.
Figure 11:
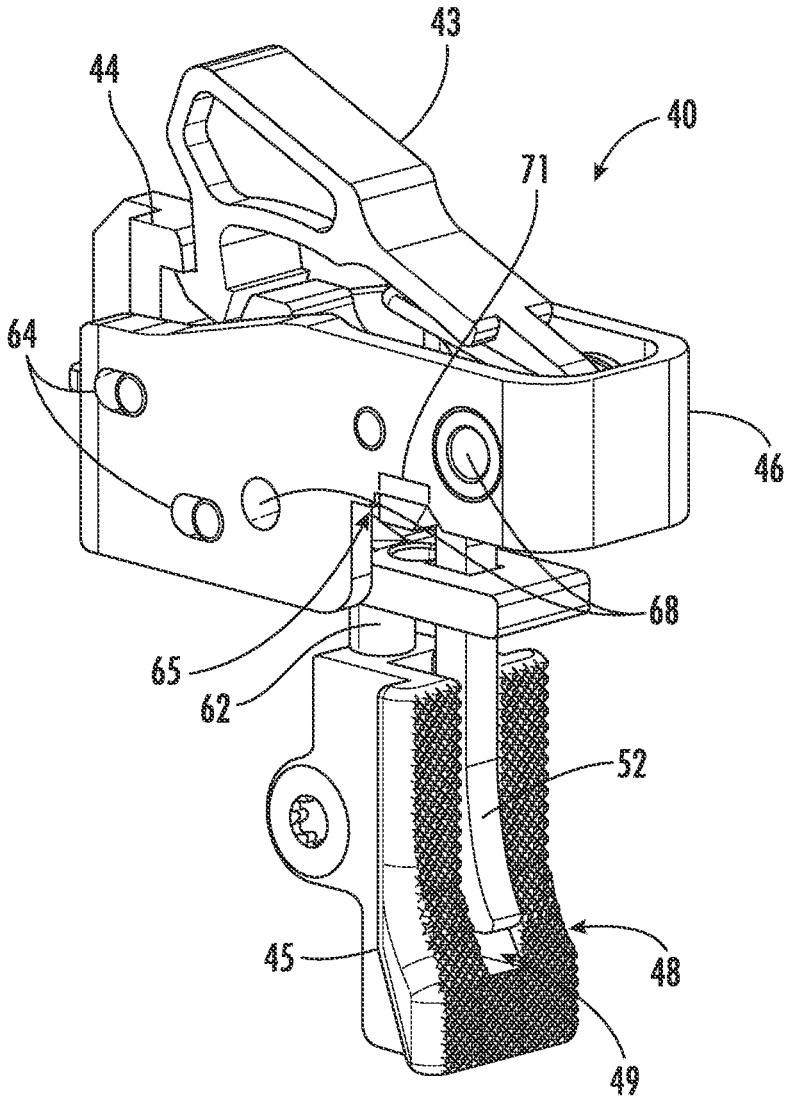
FIG. 11 is a front side perspective view of a trigger assembly group arranged and configured in accordance with the teachings of the present disclosure.
Figure 12:
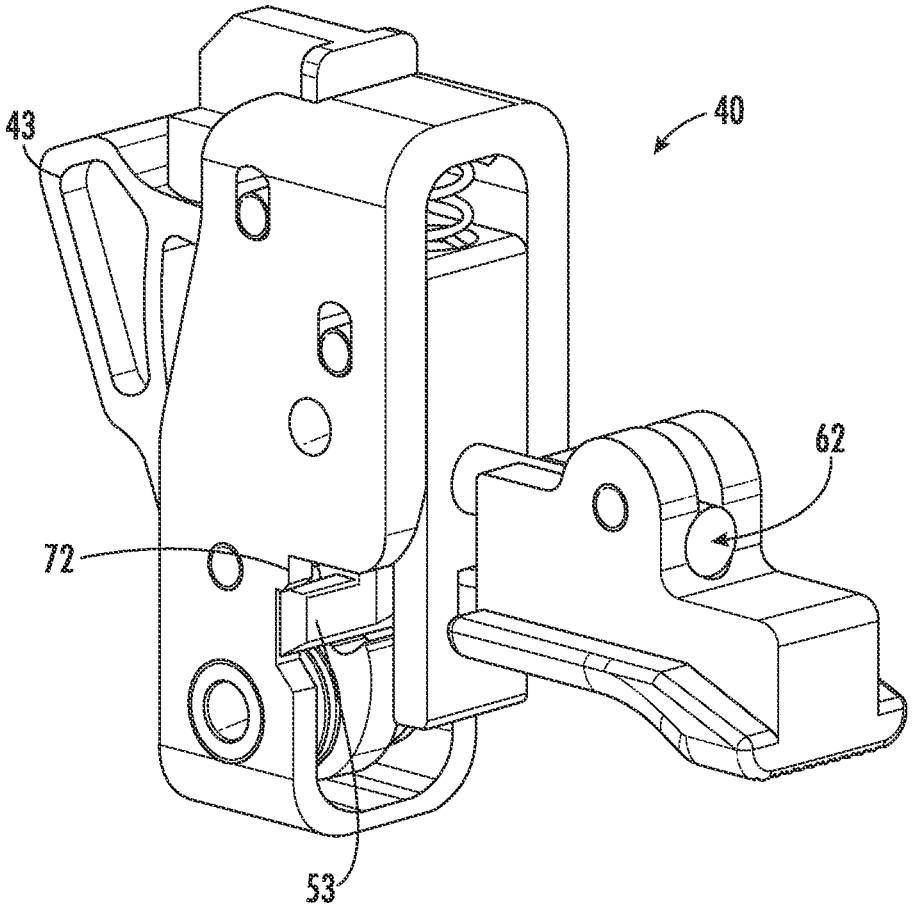
FIG. 12 is a bottom side perspective view of a trigger assembly group arranged and configured in accordance with the teachings of the present disclosure.
Figure 13:
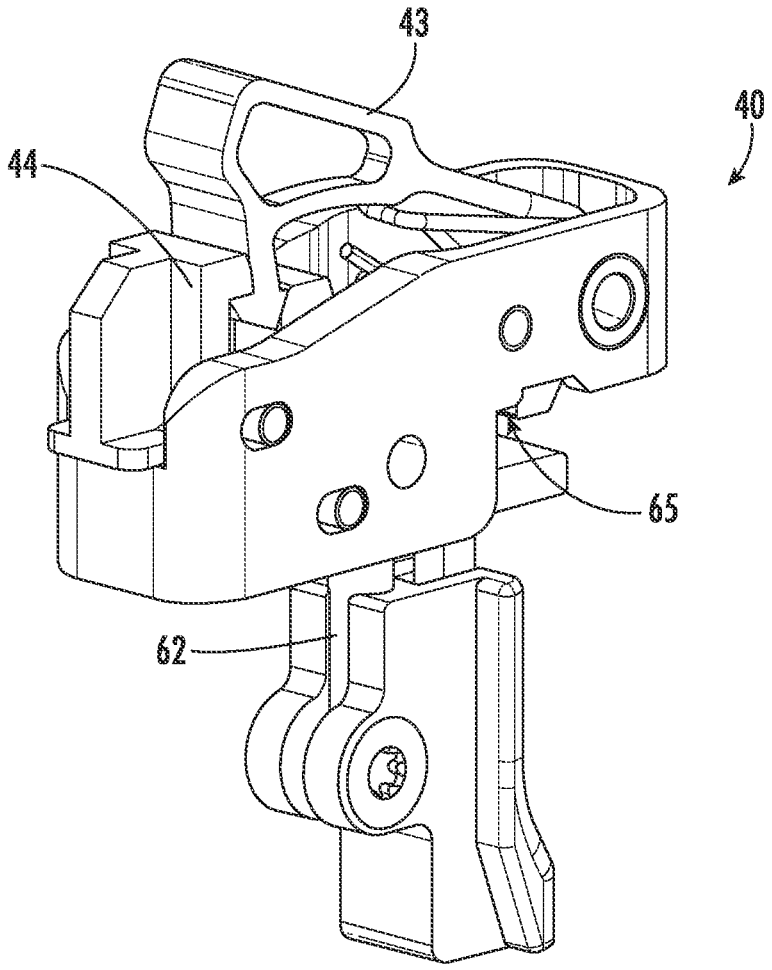
FIG. 13 is a rear side perspective view of a trigger assembly group arranged and configured in accordance with the teachings of the present disclosure.
Figure 14:
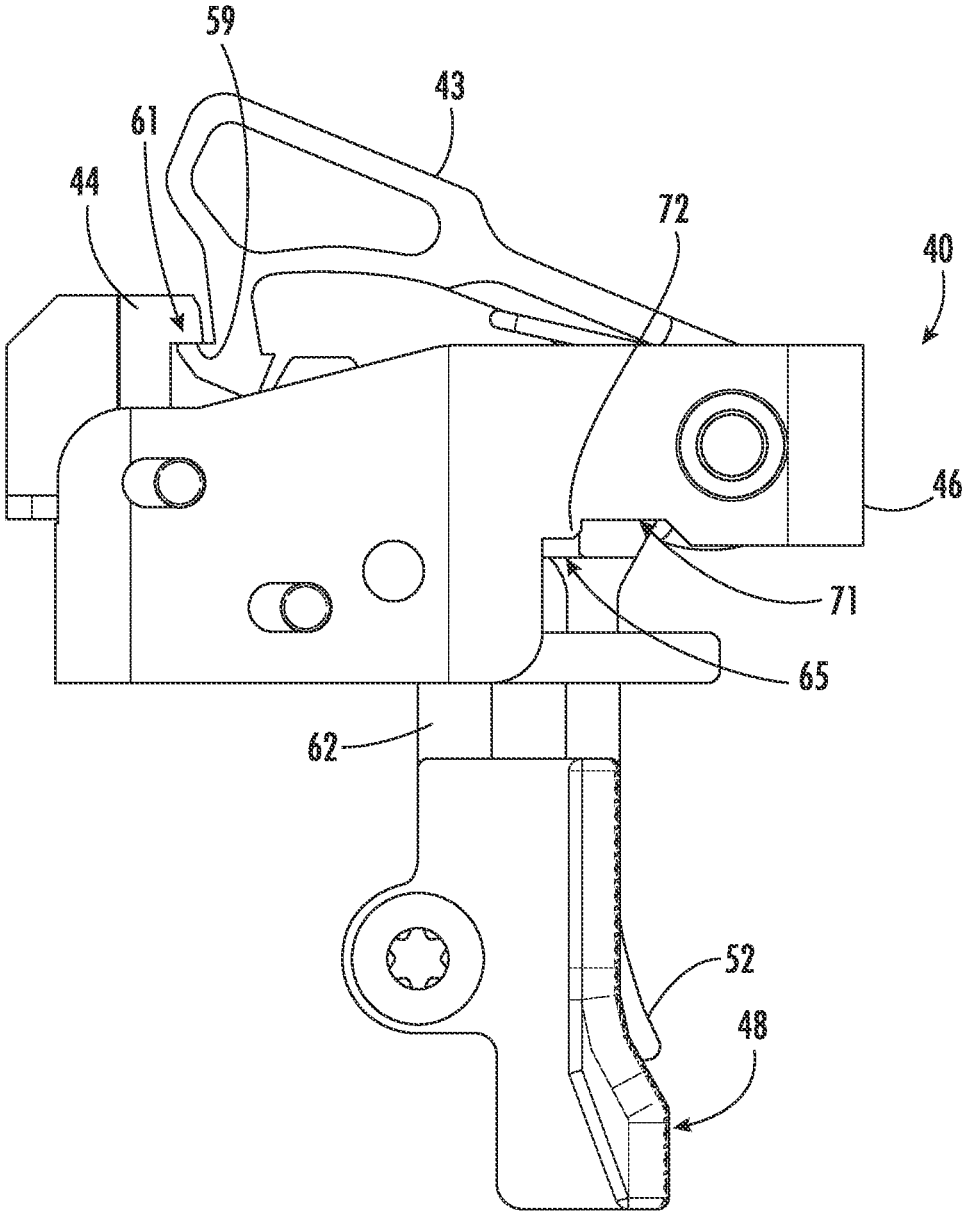
FIG. 14 is a side elevation view of a trigger assembly group arranged and configured in accordance with the teachings of the present disclosure.
Figure 15:
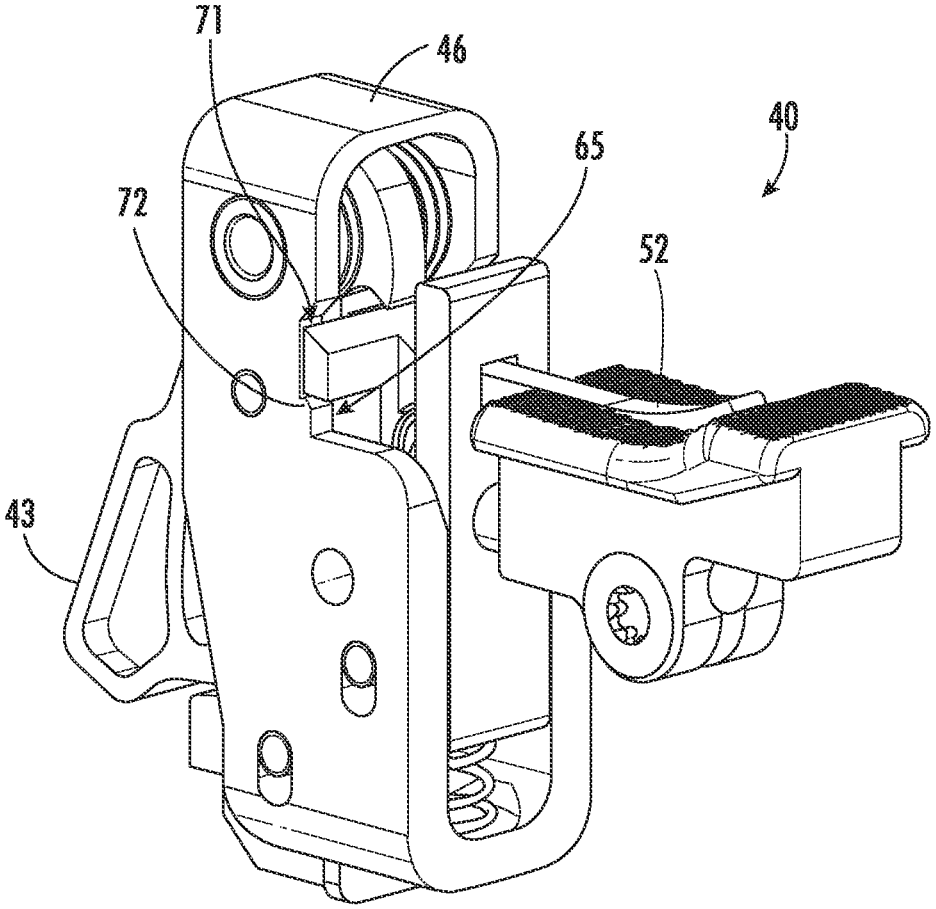
FIG. 15 is a bottom side perspective view of a trigger assembly group arranged and configured in accordance with the teachings of the present disclosure.
Figure 16:
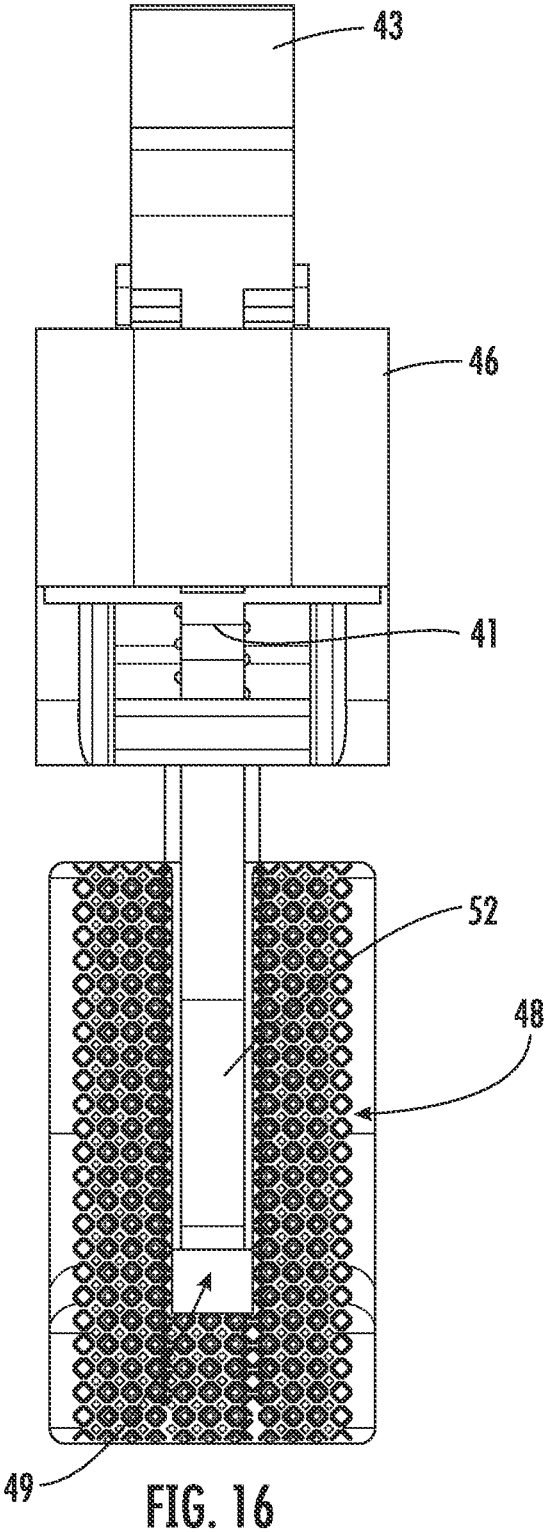
FIG. 16 is a front elevation view of a trigger assembly group arranged and configured in accordance with the teachings of the present disclosure.
Figure 17:
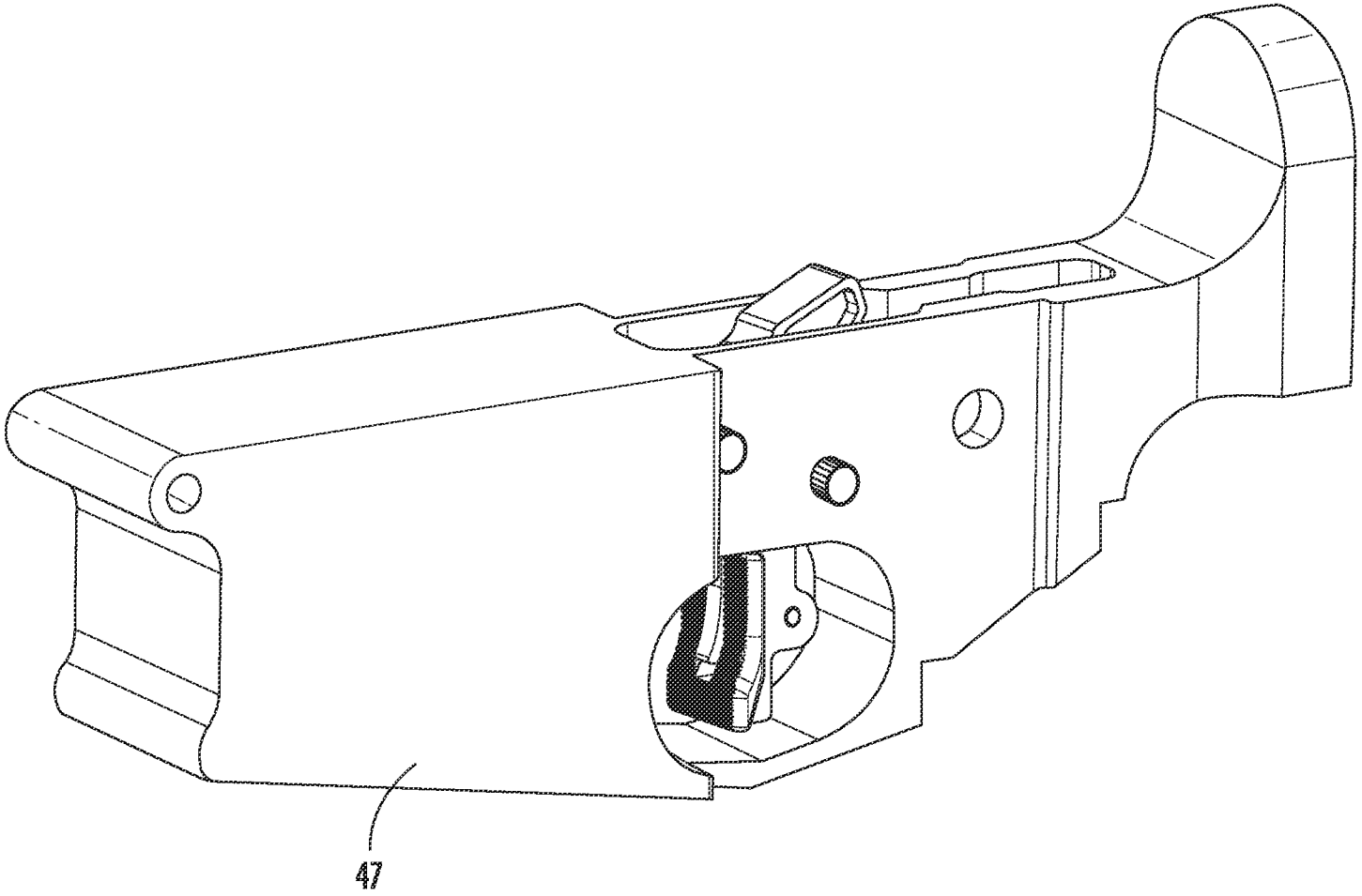
FIG. 17 is a side perspective view of a trigger assembly group, arranged and configured in accordance with the teachings of the present disclosure, installed into a prior art lower receiver.
Figure 18:
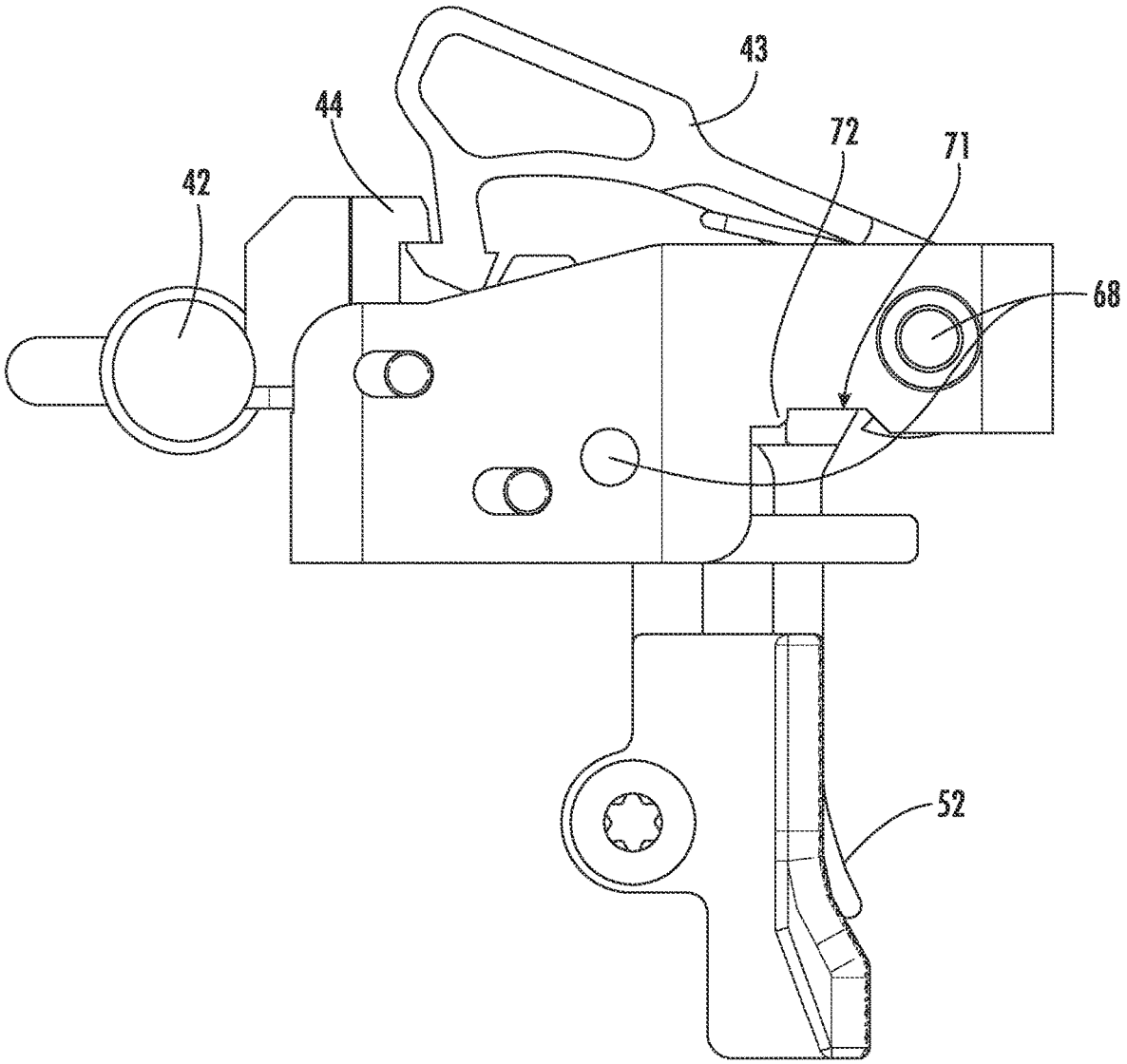
FIG. 18 is a side elevation view of a trigger assembly group arranged and configured in accordance with the teachings of the present disclosure.
Figure 19:
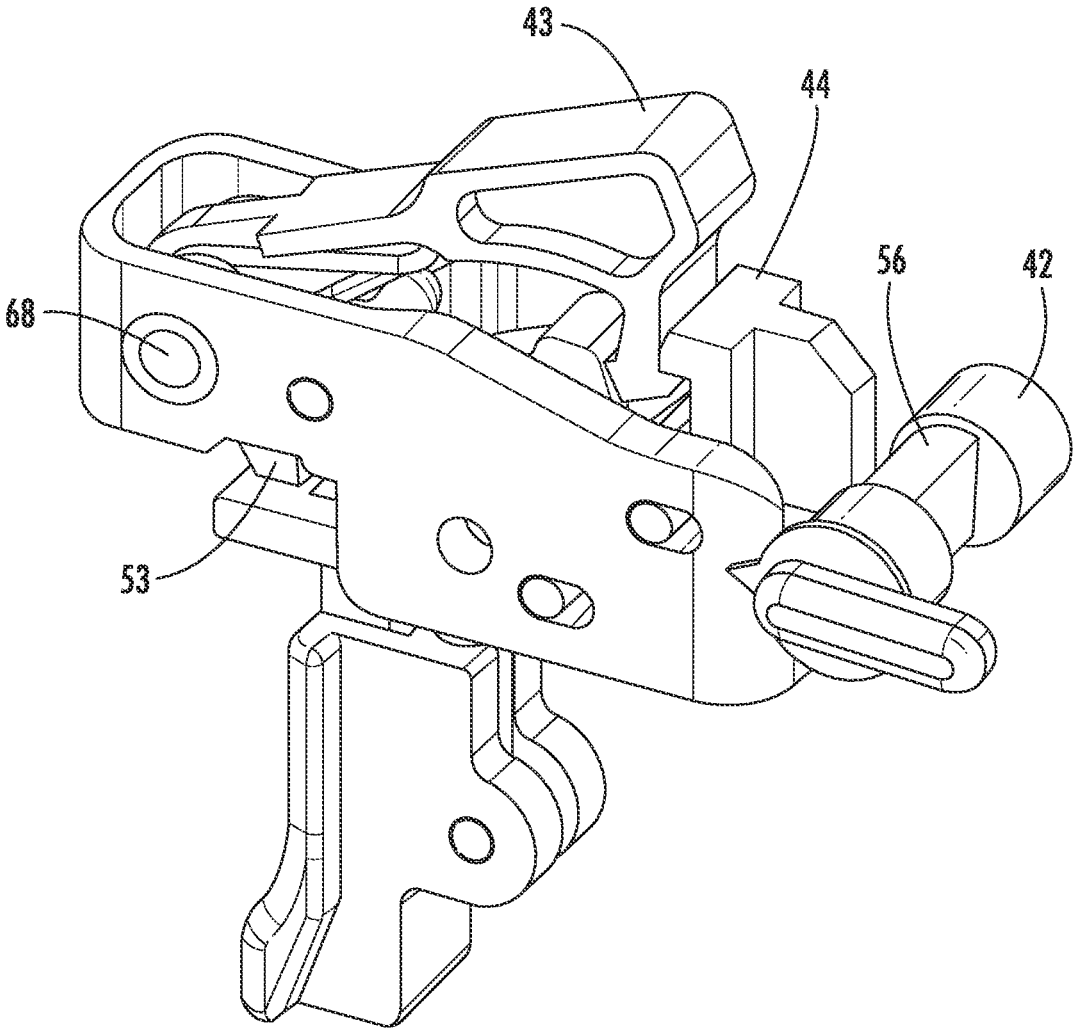
FIG. 19 is a rear side perspective view of a trigger assembly group arranged and configured in accordance with the teachings of the present disclosure.
Figure 20:
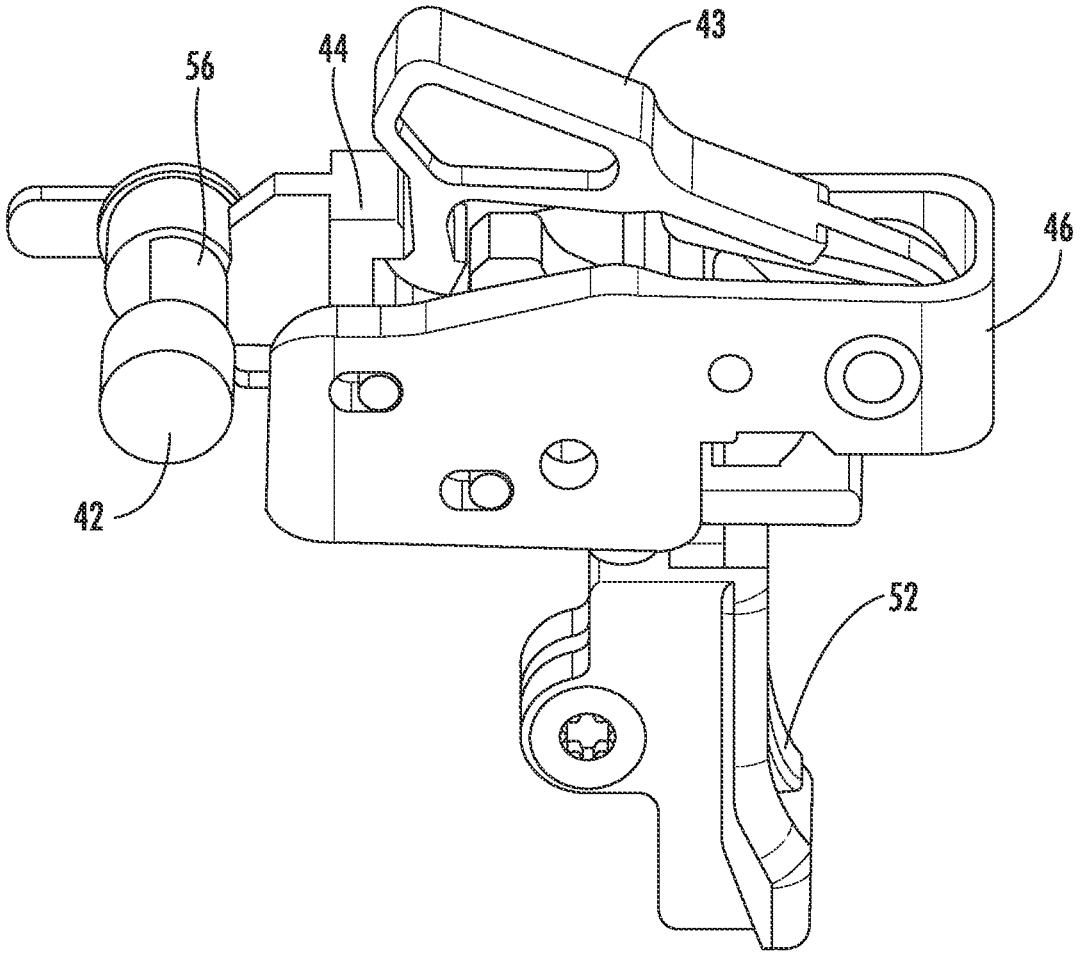
FIG. 20 is a top side perspective view of a trigger assembly group arranged and configured in accordance with the teachings of the present disclosure.
Figure 21:
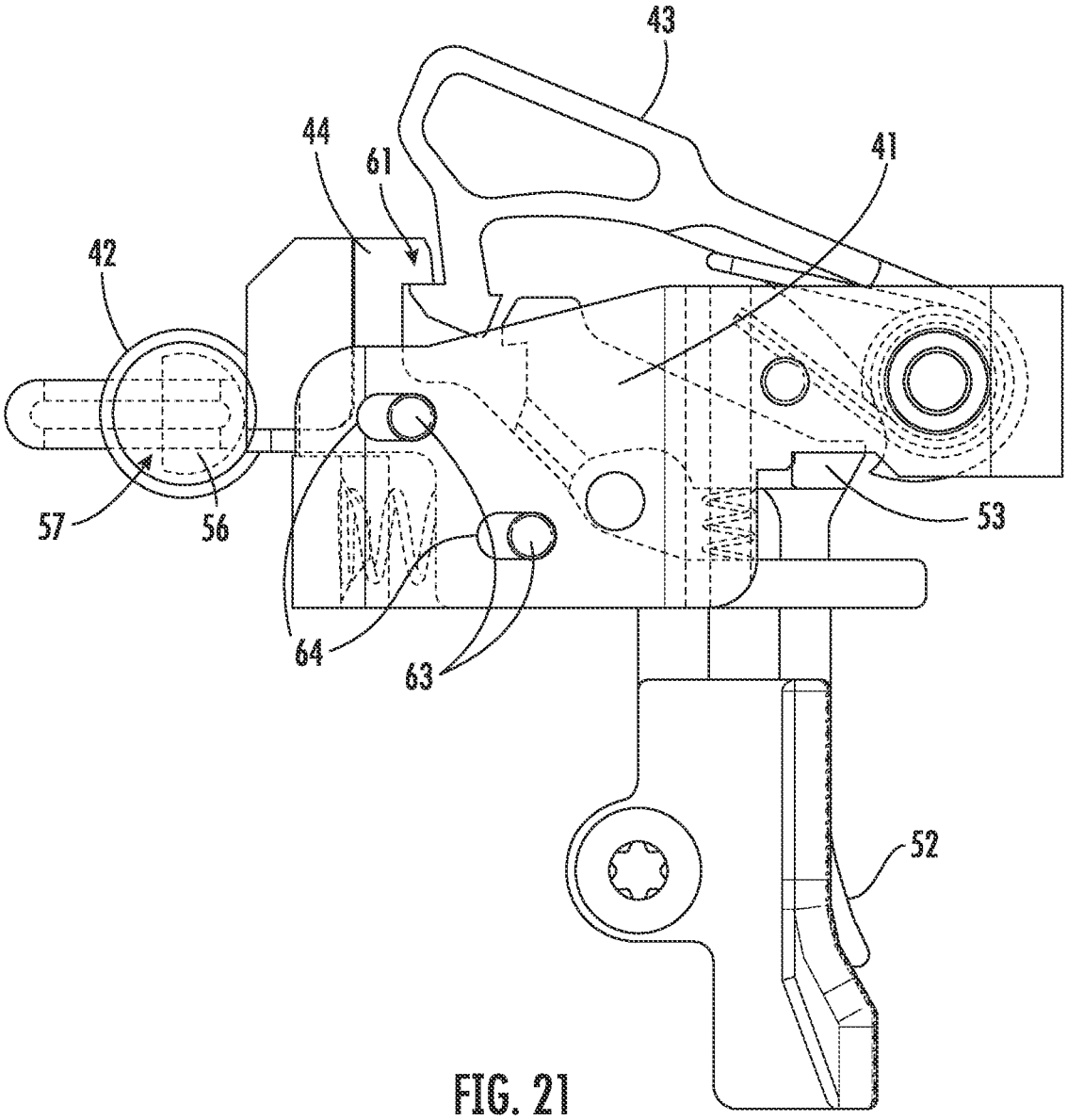
FIG. 21 is a side elevation view of a trigger assembly group arranged and configured in accordance with the teachings of the present disclosure.

FIG. 10 illustrates an exemplary primary trigger 44 in accordance with the present disclosure including a primary trigger sear 61, wherein the trigger sear 61 includes a sloped front surface 70. The primary trigger sear 61 engages, catches, and holds a cocked hammer 43 (see FIGS. 4, 9, 11, 14, 18-23, and 30) until the primary trigger 44 and the secondary trigger 41 are pulled by a user to fire the firearm. The primary trigger 44 may further comprise a rear channel 74 in the primary trigger 44 for receiving the connecting member 54 of the secondary trigger 41. The primary trigger 44 may further comprise a forward channel 76 in the primary trigger 44 for receiving the lower portion 75 of the secondary trigger 41. The depicted primary trigger 44 further includes a lower portion 62 and retaining pin apertures 73 for receiving retaining pins 63. A primary trigger resilient member 50 (e.g., a compression spring) may be used to move the primary trigger 44 in respect to the housing 46.

FIGS. 9, 11-24, and 30-31 depict a trigger shoe 45 connected to the primary trigger 44. Please note, in other exemplary embodiments anticipated by the present disclosure, the trigger shoe 45 may be formed integrally with the primary trigger 44. The front face 48 of the trigger shoe 45 is configured for engagement and pulling of the trigger shoe by a user's finger. The depicted trigger shoe 45 further comprises a channel 49 formed in the trigger shoe 45, which channel 49 is configured as a recess that allows the lower portion 75 of the secondary trigger 41 to move from (1) extending outwardly in front of the front face 48 the trigger shoe 45, allowing for engagement of a user's finger with the front face 52 of the lower portion of the secondary trigger (see, e.g., FIGS. 4, 9, 11, and 14), to (2) withdrawing rearwardly in the channel 49 until the front face 52 of the lower portion of the secondary trigger is fully recessed within the channel 49 formed in the trigger shoe 45 (see, e.g., FIGS. 7, 24 and 31).

Figure 3:
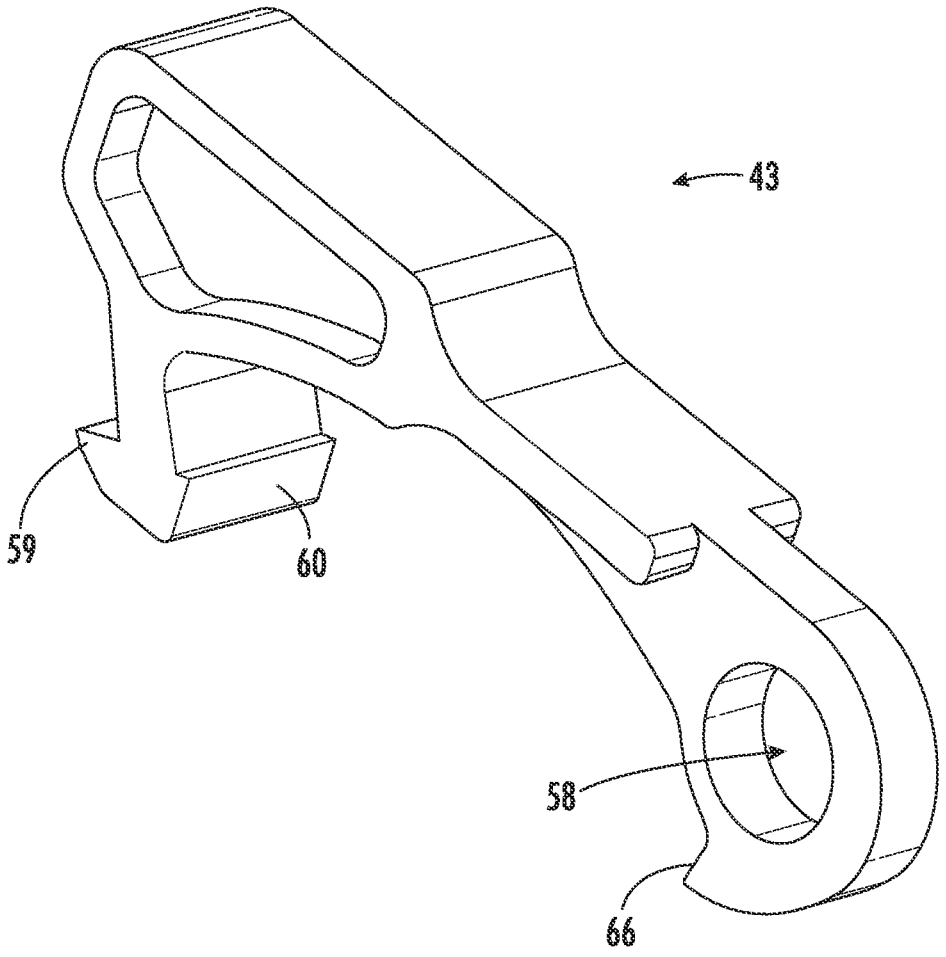
FIG. 3 is a top side perspective view of a hammer arranged and configured in accordance with the teachings of the present disclosure.
Figure 4:
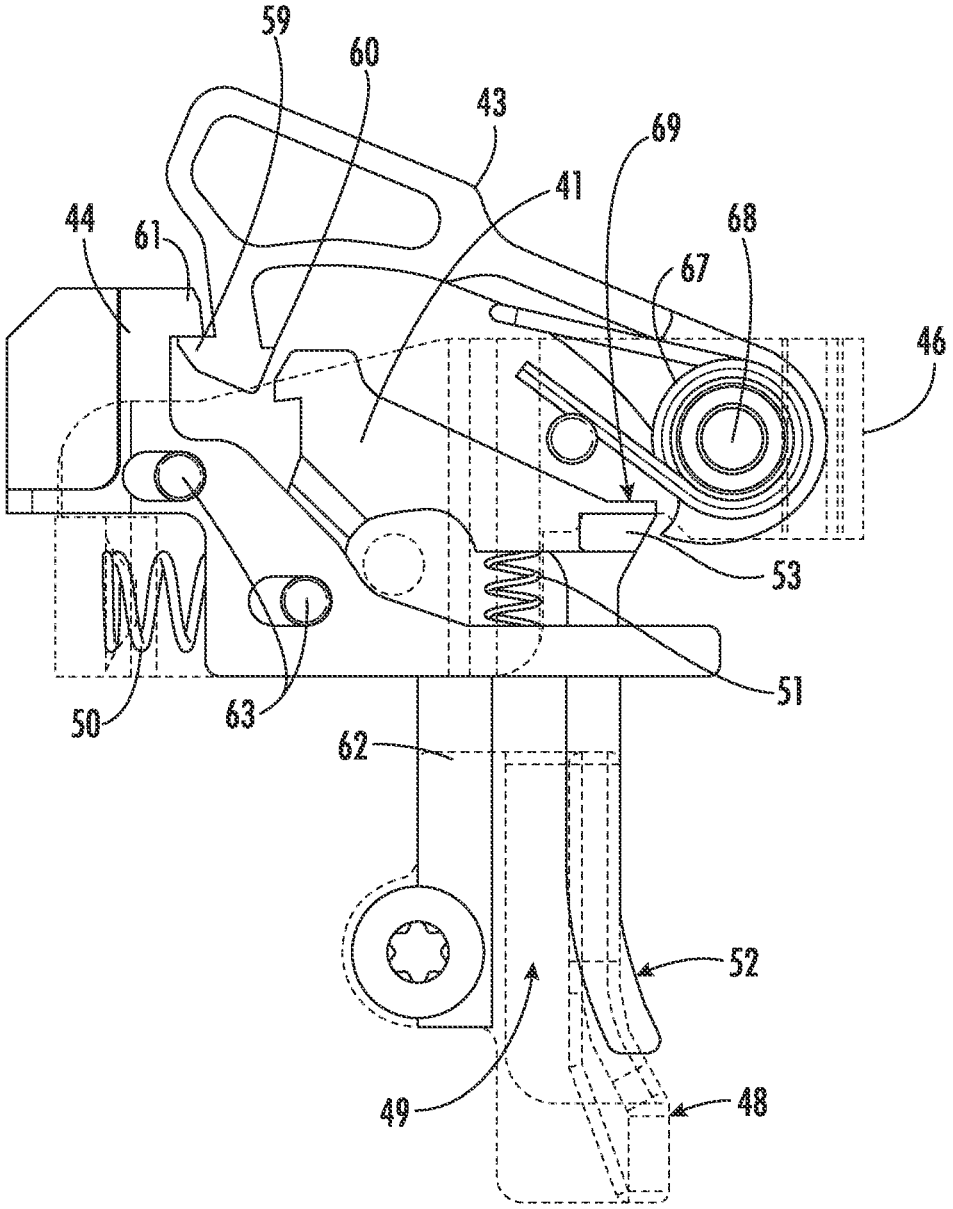
FIG. 4 is a side elevation view of a trigger assembly group arranged and configured in accordance with the teachings of the present disclosure.

FIG. 3 depicts a hammer 43 that comprises a rear hammer catch 59 for engaging the primary trigger sear 61. The hammer 43 may further include a front hammer hook member 60 for transitory engagement with the disconnector head 55 of the secondary trigger 41 while the firearm cycles. The hammer 43 may further include a forward hammer unlocking protrusion 66 for engaging with the secondary trigger unlocking protrusion 69 to force the locking wings members 53 of the secondary trigger 41 out of engagement with the upper locking housing grooves 71 and into engagement with the lower housing grooves 65 under the shoulders 72 of the housing 46. As shown in FIGS. 3, 4, and 9, the hammer 43 may further include an aperture 58 for receiving a hammer pivot sleeve 77 and for further receiving a trigger pack retaining bolt 68 inserted through the hammer pivot sleeve 77. Finally, a hammer spring 67 or resilient member (e.g., a torsion spring) is depicted which biases the hammer 43 forward to strike the firing pin when the triggers are pulled to release the hammer 43 from engagement with the primary trigger sear 61.

Figure 2:
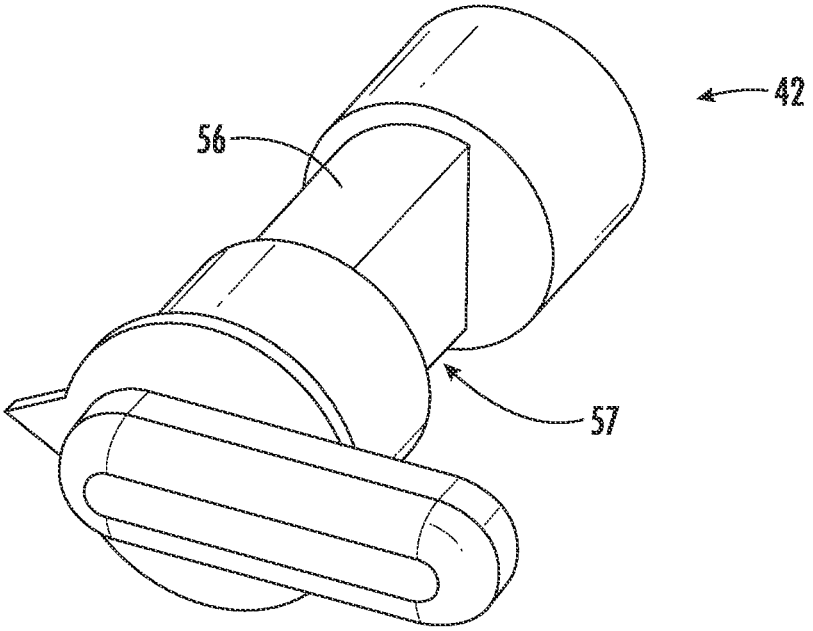
FIG. 2 is a top side perspective view of a safety selector arranged and configured in accordance with the teachings of the present disclosure.

FIG. 2 depicts an exemplary safety selector 42 comprising a solid safety side 56 that prevents movement of the trigger assembly group 40 and a cut out or cavity 57 on the opposing side that allows for actuation of the triggers and rearward movement of the trigger assembly group 40. The safety selector 42 is used to adjust a firearm from a safe position, in which the triggers cannot be pulled and the weapon cannot be fired (see FIG. 21), to a fire position, in which a user is able to pull the triggers to fire the weapon (see FIG. 23). It should be appreciated that many alternative safety selectors 42 are possible, as will be known to those skilled in the art.

Turning to FIG. 4, the trigger assembly group 40 is shown in its forwardmost position in the housing 46, as can be seen by the position of the retaining pins 63. The hammer 43 is cocked as the primary trigger sear 61 engages the rear hammer catch 59, and the primary and secondary triggers are ready to be pulled in a rearward linear direction to discharge the firearm. The front face 52 of the lower portion of the secondary trigger 41 extends outwardly beyond the front face 48 of the trigger shoe 45. This is the arrangement and configuration of the trigger assembly group 40 and housing 46 when the hammer 43 is cocked, and the triggers are ready to be pulled to discharge the firearm.

Figure 5:
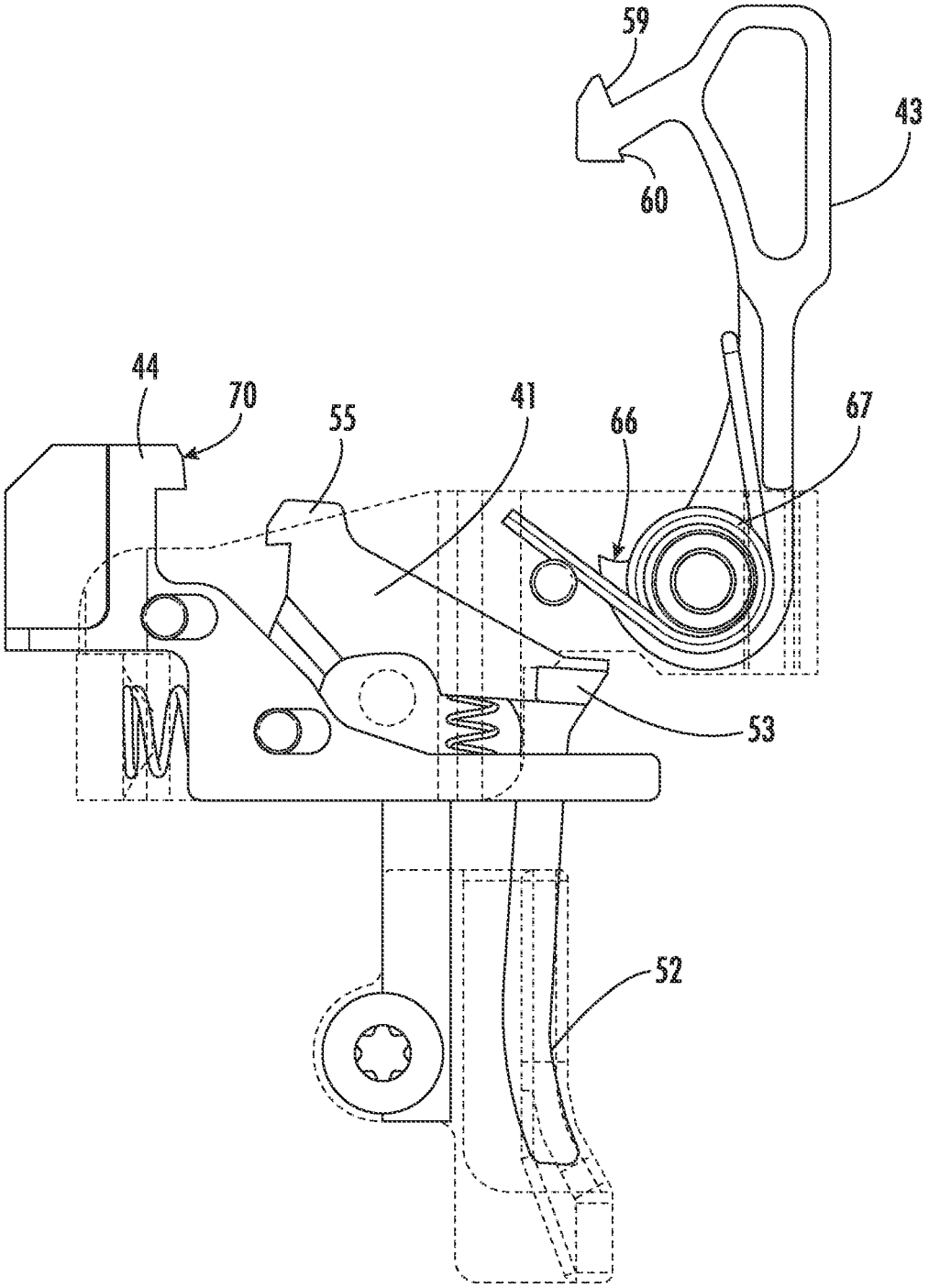
FIG. 5 is a side elevation view of a trigger assembly group arranged and configured in accordance with the teachings of the present disclosure.

In FIG. 5, the secondary trigger, trigger shoe, and primary trigger have been pulled rearwardly and the hammer 43 is in a released position. To pull the triggers, the front face 52 of the lower portion of the secondary trigger 41 is first pulled rearwardly until the secondary trigger 41 recedes into the channel 49 formed in the trigger shoe 45 such that the front face 52 of the lower portion of the secondary trigger 41 is flush with the front face 48 of the trigger shoe 45. With continued rearward pulling of the lower portion 75 of the secondary trigger 41 and of the front face 48 of the trigger shoe 45, the locking wing members 53 of the secondary trigger 41 move out of engagement with the upper locking housing grooves 71, and the locking wing members 53 move below the shoulders 72 of the housing and into engagement with lower housing grooves 65 located beneath the shoulders 72 of the housing. This forces the lower portion 75 of the secondary trigger 41 to retract further into the trigger shoe channel 49, causing the front face 52 of the lower portion of the secondary trigger 41 to be receded within and no longer flush with the front face 48 of the trigger shoe 45. As a result, the secondary trigger 41 is no longer in contact with the user's finger.

Figure 6:
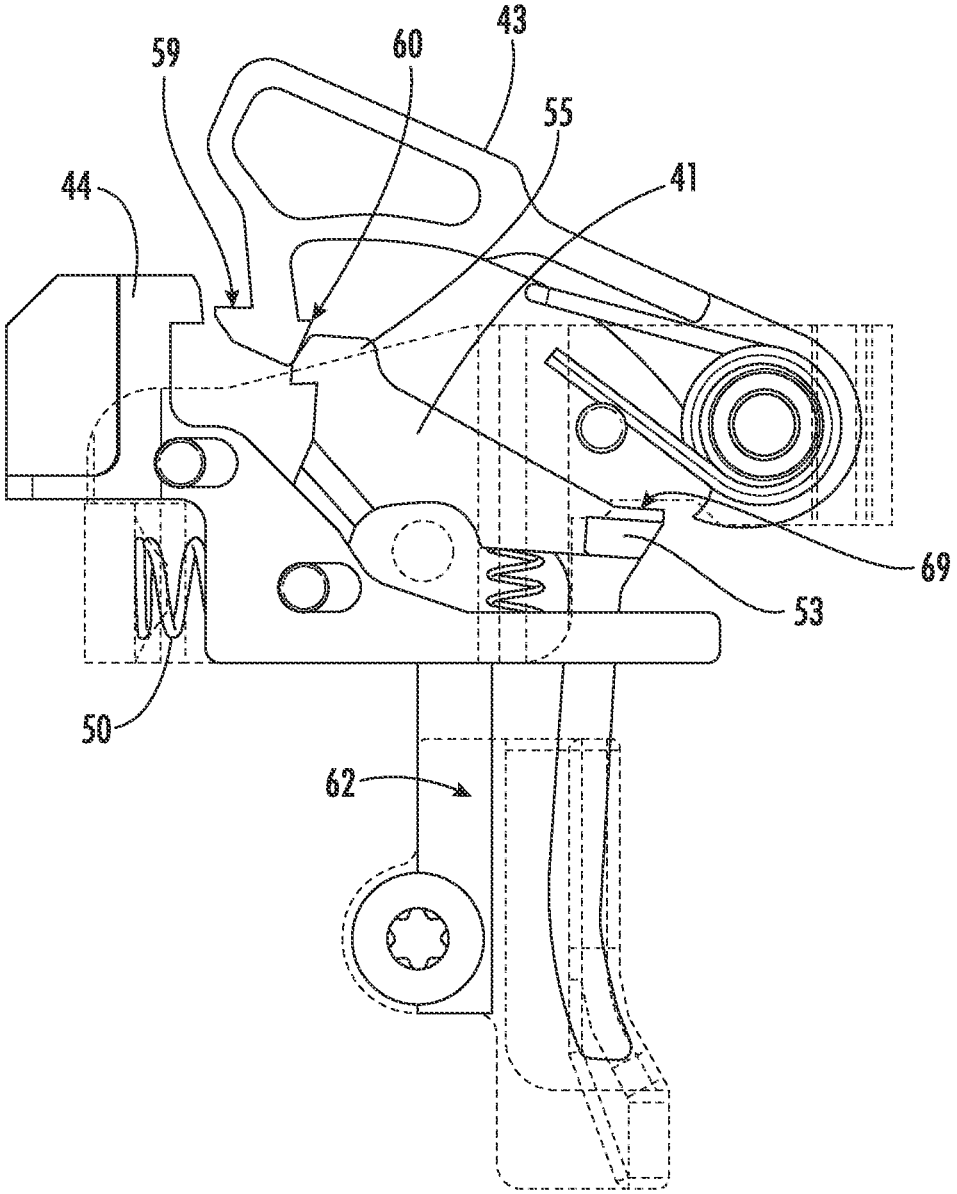
FIG. 6 is a side elevation view of a trigger assembly group arranged and configured in accordance with the teachings of the present disclosure.

Moving to FIG. 6, when the firearm's bolt carrier group is cycled and starts to force the hammer 43 in a downward direction and back into a cocked position in engagement with the primary trigger sear 61, the front hammer hook member 60 starts to engage the disconnector head 55 of the secondary trigger 41. As can be seen by the location of the retaining pins 63 in the linear retaining pin apertures 64, the trigger assembly group 40 is now positioned in a rearmost position in the housing 46 as the trigger shoe 45 continues to be pulled rearwardly by the user's finger and the primary trigger resilient member 50 is being compressed.

Figure 7:
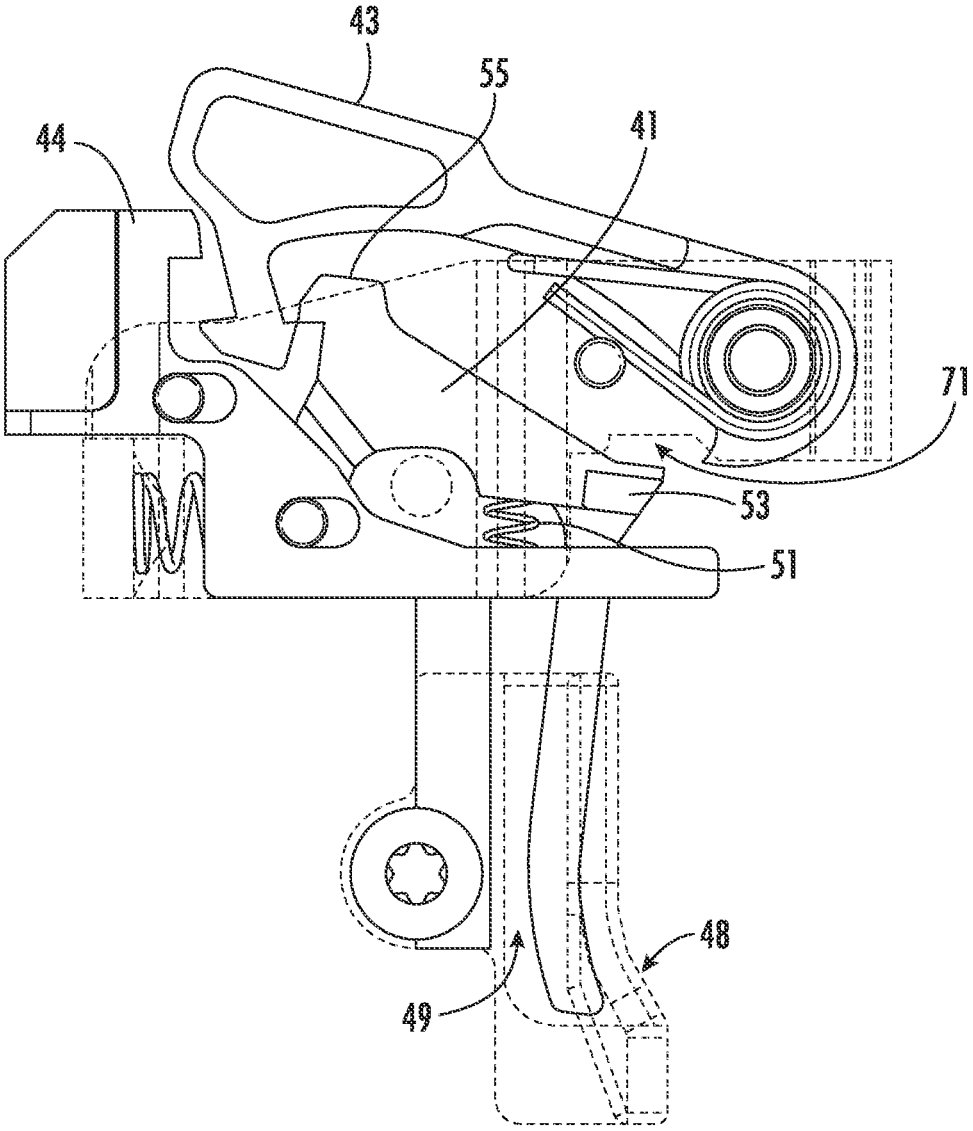
FIG. 7 is a side elevation view of a trigger assembly group arranged and configured in accordance with the teachings of the present disclosure.

In FIG. 7, the hammer 43 is forced further down by the continued rearward travel of the bolt carrier group (not depicted). The front hammer hook member 60 is almost positioned low enough to engage the disconnector head 55 of the secondary trigger 41. The secondary trigger resilient member 51 is being compressed as the trigger shoe continues to be pulled rearwardly by the user's finger.

Figure 8:
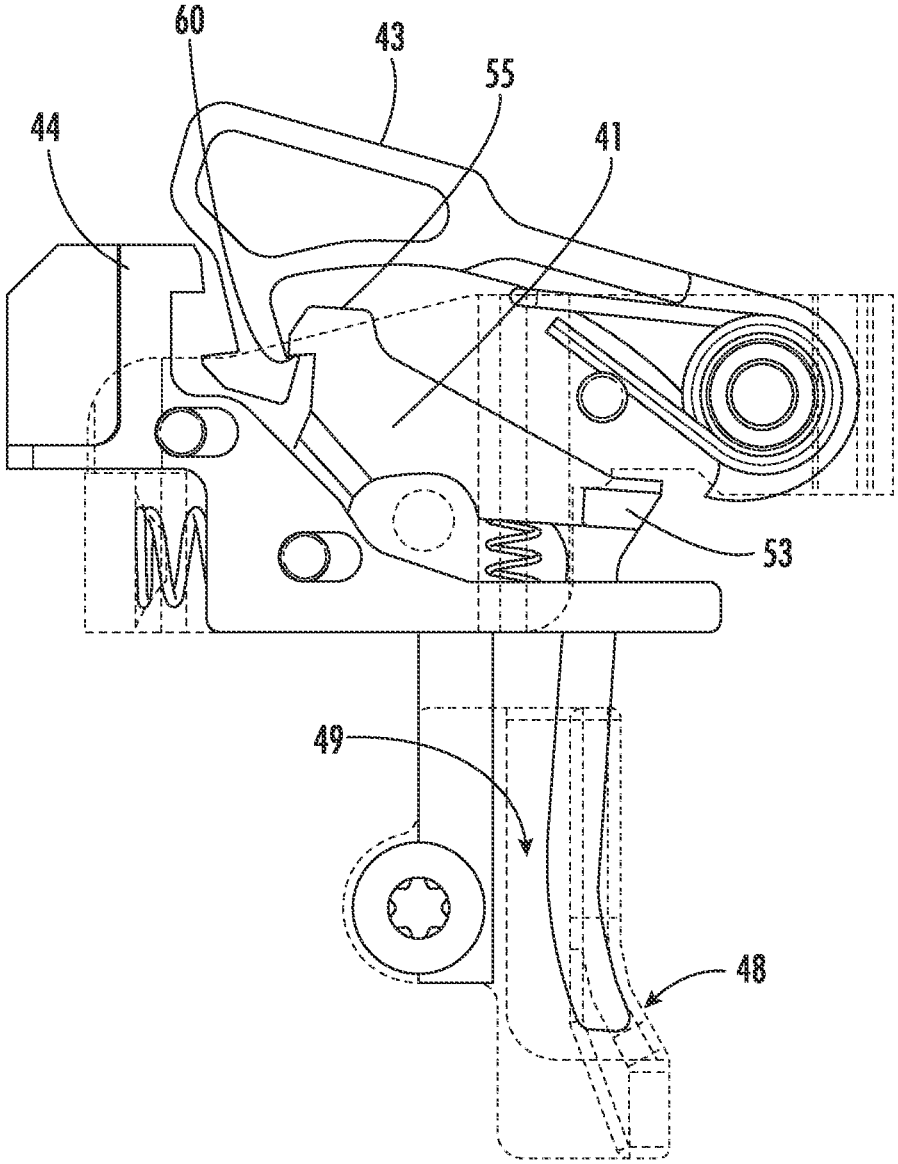
FIG. 8 is a side elevation view of a trigger assembly group arranged and configured in accordance with the teachings of the present disclosure.

Next, as depicted in FIG. 8, the front hammer hook member 60 moves past and below the disconnector head 55 of the secondary trigger 41, allowing the disconnector head 55 of the secondary trigger 41 to temporarily hold the hammer 43 in place.

Finally, returning to FIG. 4, the user has released his/her finger from the front face 52 of the secondary trigger 41 and from the trigger shoe 45, and the hammer 43 has reset in a cocked position. When the user releases his/her finger, this causes the primary trigger resilient member 50 (e.g., the compression spring) to force the trigger assembly group 40 forward in the housing 46, the front hammer hook member 60 to disengage from the disconnector head 55 of the secondary trigger 41, and as the hammer 43 is forced upwardly by the hammer spring 67, the hammer 43 engages and is held in place by the primary trigger sear 61. The locking wings 53 of the secondary trigger 41 are forced back up into the upper locking housing grooves 71 by the secondary trigger resilient member 51.

Figure 22:
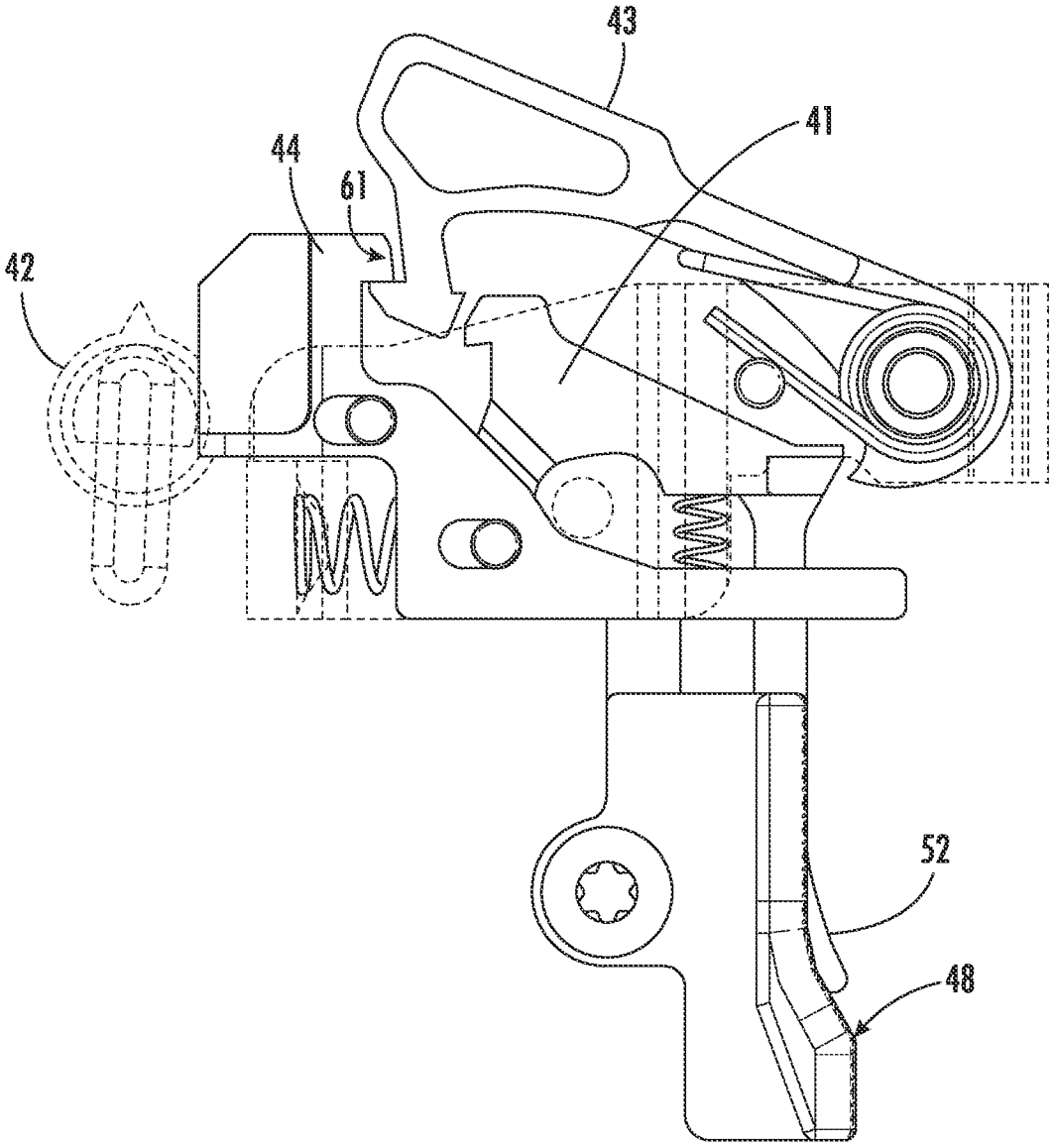
FIG. 22 is a side elevation view of a trigger assembly group arranged and configured in accordance with the teachings of the present disclosure.
Figure 23:
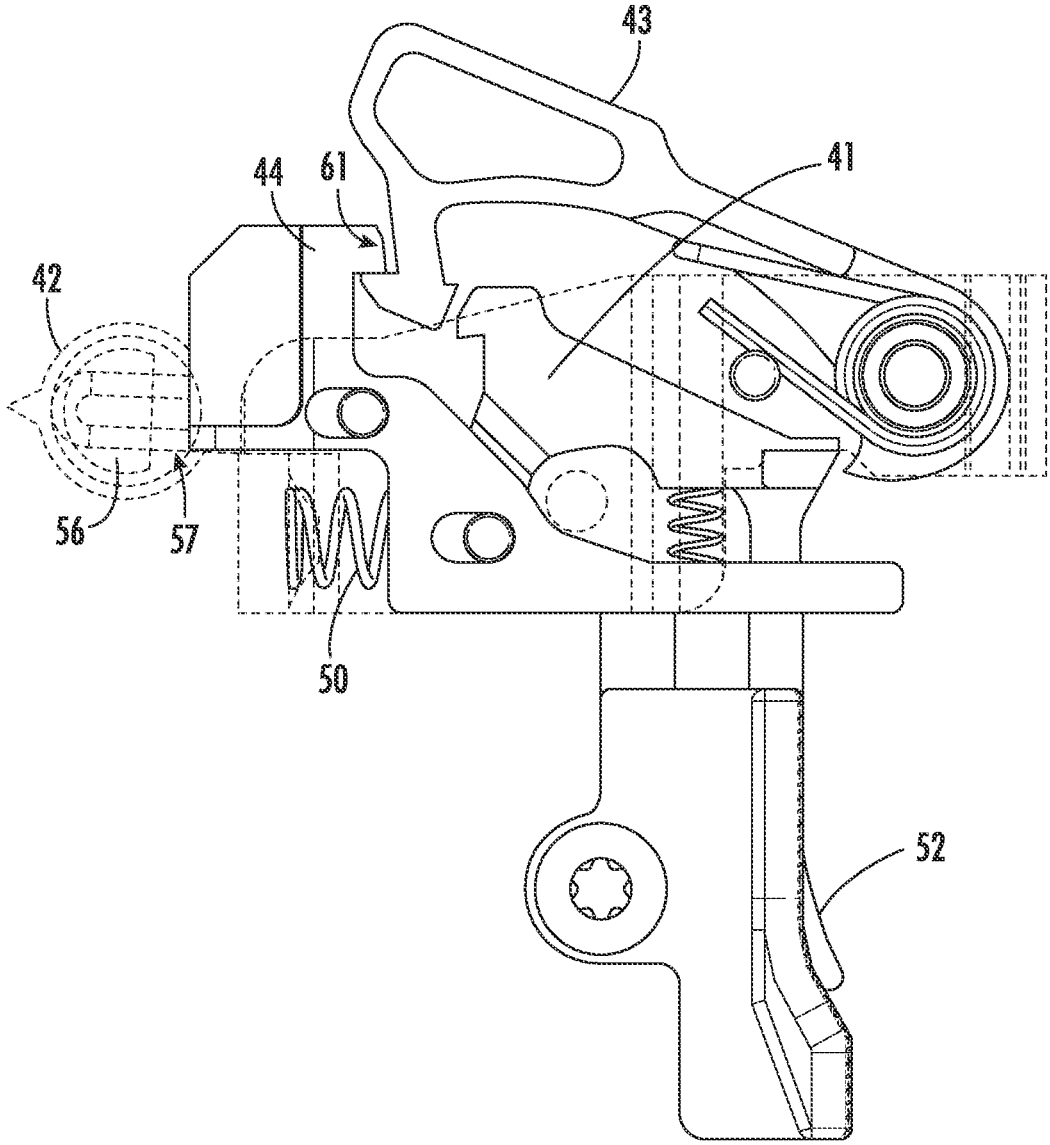
FIG. 23 is a side elevation view of a trigger assembly group arranged and configured in accordance with the teachings of the present disclosure.
Figure 24:
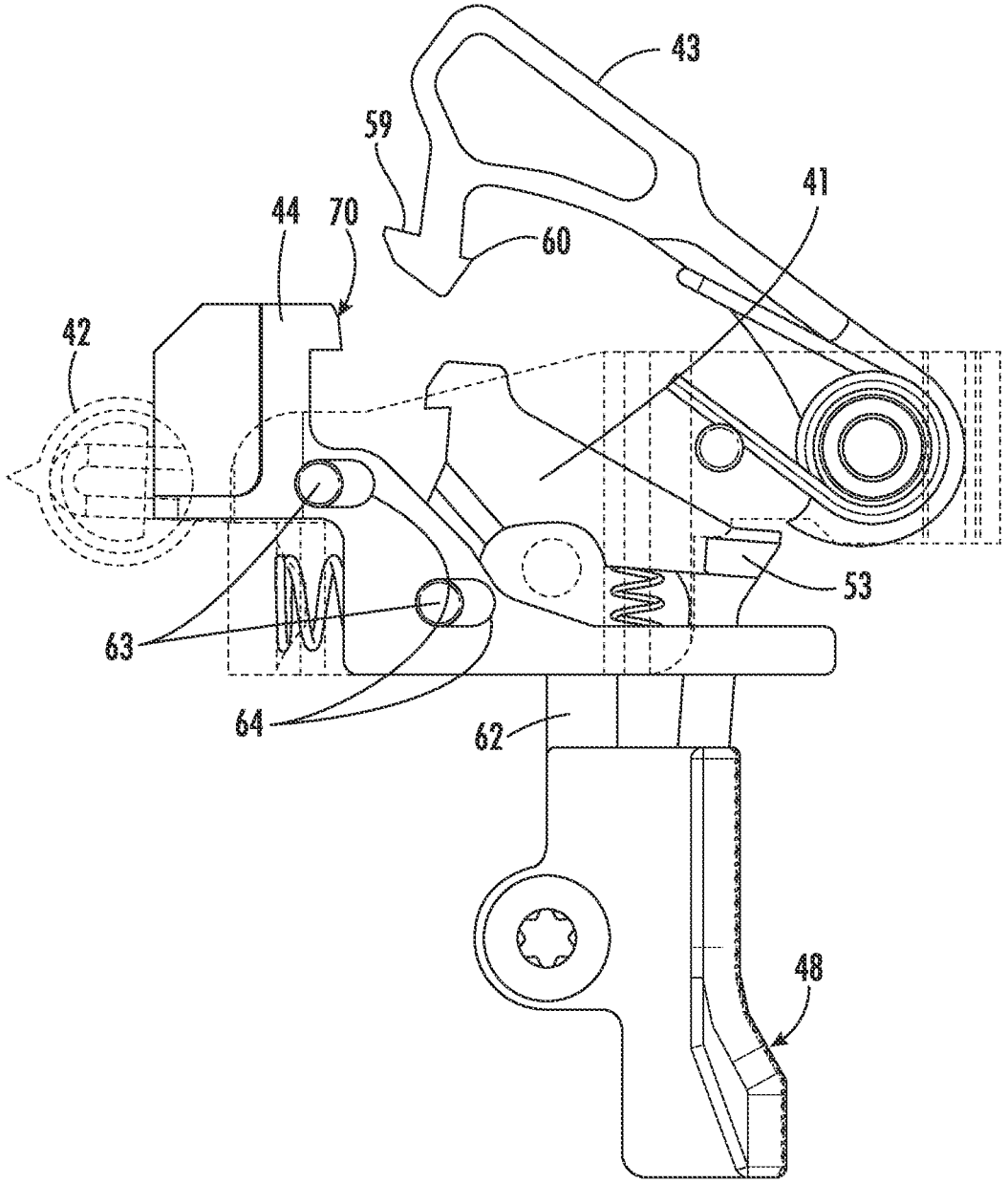
FIG. 24 is a side elevation view of a trigger assembly group arranged and configured in accordance with the teachings of the present disclosure.

Now, turning to FIGS. 21-24, FIG. 21 depicts the trigger assembly group 40 including a safety selector 42 wherein the safety selector 42 is positioned to hold the firearm in a safe position, and wherein the trigger assembly group 40 is locked by the safety selector in a forwardmost position in the housing 46 (see the retaining pins 63) and the firearm is unable to be discharged in this position as the primary and secondary triggers cannot be pulled rearwardly to release the hammer to discharge the firearm. FIG. 22 depicts the safety selector 42 being turned to unlock the trigger assembly group from the safe position. FIG. 23 depicts the safety selector 42 positioned to unlock the trigger assembly group and to allow the trigger assembly group 40 to move rearwardly upon pulling of the triggers. In this drawing, the primary trigger resilient member 50 is holding the trigger assembly group 40 in the forwardmost position; however, this resilient force can be overcome by a user pulling the triggers rearwardly to discharge the firearm. Finally, FIG. 24 depicts the trigger assembly group after the primary and secondary triggers are pulled rearwardly, in a linear direction—the trigger assembly group 40 moves rearwardly (see the position of the retaining pins 63 in the retaining pin apertures 64) and the hammer 43 is released when the rear hammer catch 59 moves out of engagement with the primary trigger sear 61. The lower portion 75 of the secondary trigger 41 recedes further into the channel 49 of the trigger shoe 45 when the primary and secondary triggers continue to be pulled rearwardly. As the primary and secondary triggers are pulled rearwardly, the locking wing members 53 are forced out of engagement with the upper locking housing grooves 71 and out of engagement with the shoulders 72 of the housing 46 and the locking wing members move into engagement with the lower housing grooves. When the lower portion 75 of the secondary trigger 41 recedes further into the channel 49 of the trigger shoe 45 as the locking wing members engage the lower housing grooves, this configuration eliminates "trigger slap" from the secondary trigger when the bolt carrier group forces the hammer 43 back down into a cocked position.

Figure 25:
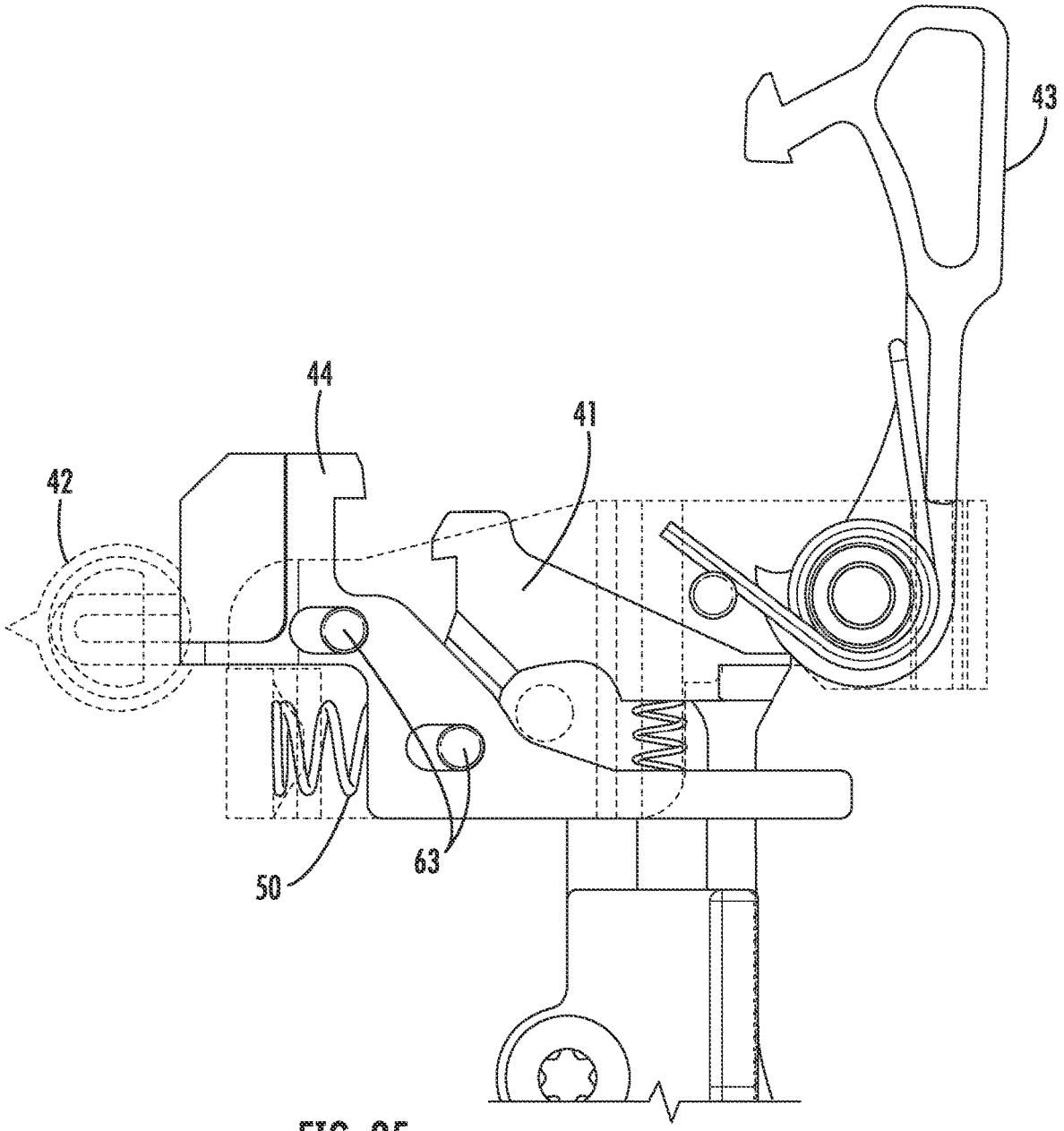
FIG. 25 is a partial side elevation view of a trigger assembly group arranged and configured in accordance with the teachings of the present disclosure.

Turning to FIGS. 25-30, FIG. 25 depicts the first step of resetting the primary and secondary triggers after the firearm has been discharged. FIG. 25 shows the trigger assembly group 40 after the firearm has been fired and the hammer 43 is in a released position. The triggers have been released by the user's finger, and the primary trigger resilient member 50 forces the trigger assembly group 40 forward. The trigger assembly group 40 is at its forwardmost linear position in the housing 46, as can be seen by the position of the retaining pins 63 in the linear retaining pin apertures 64. The forward hammer unlocking protrusion 66 is disposed above and is disengaged from the secondary trigger unlocking protrusion 69. The locking wing members 53 of the secondary trigger 41 are engaged with the upper locking housing grooves 71 and positioned against the shoulders 72 of the housing 46. The front face 52 of the lower portion of the secondary trigger 41, arranged and configured for engagement and pulling of the secondary trigger 41 by a user's finger, extends outwardly from the front face 48 of the trigger shoe 45 (not fully illustrated).

Figure 26:
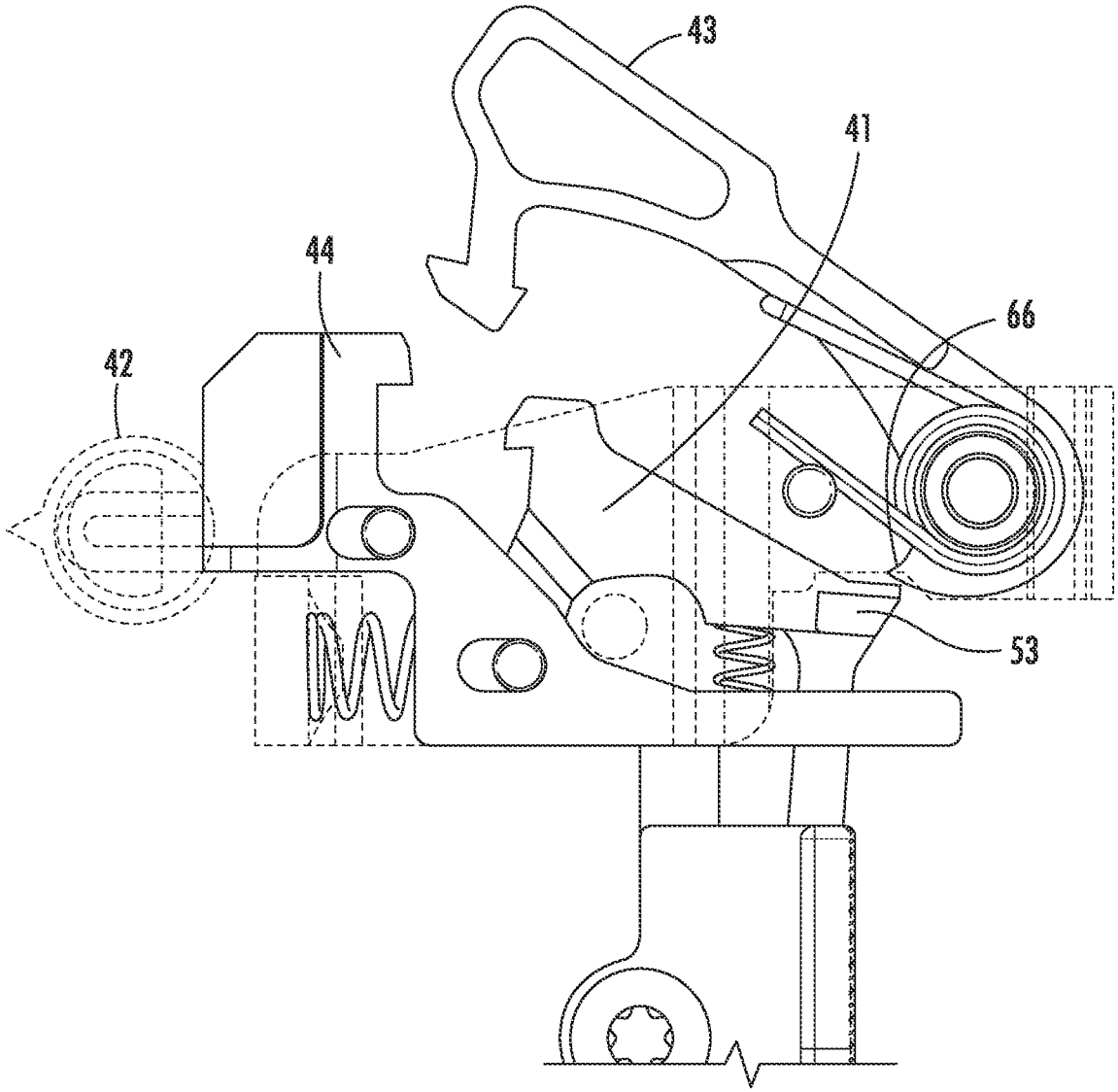
FIG. 26 is a partial side elevation view of a trigger assembly group arranged and configured in accordance with the teachings of the present disclosure.

Next, in FIG. 26, the hammer 43 is being forced downwardly by a bolt carrier group (not depicted) of the firearm during manual cycling. The forward hammer unlocking protrusion 66 and the secondary trigger unlocking protrusion 69 are starting to interact; as the hammer is forced further downwardly, the forward hammer unlocking protrusion 66 forces the secondary trigger unlocking protrusion 69 downward, which forces the locking wing members 53 out of engagement with both the upper locking housing grooves 71 and the shoulders 72 of the housing 46.

Figure 27:
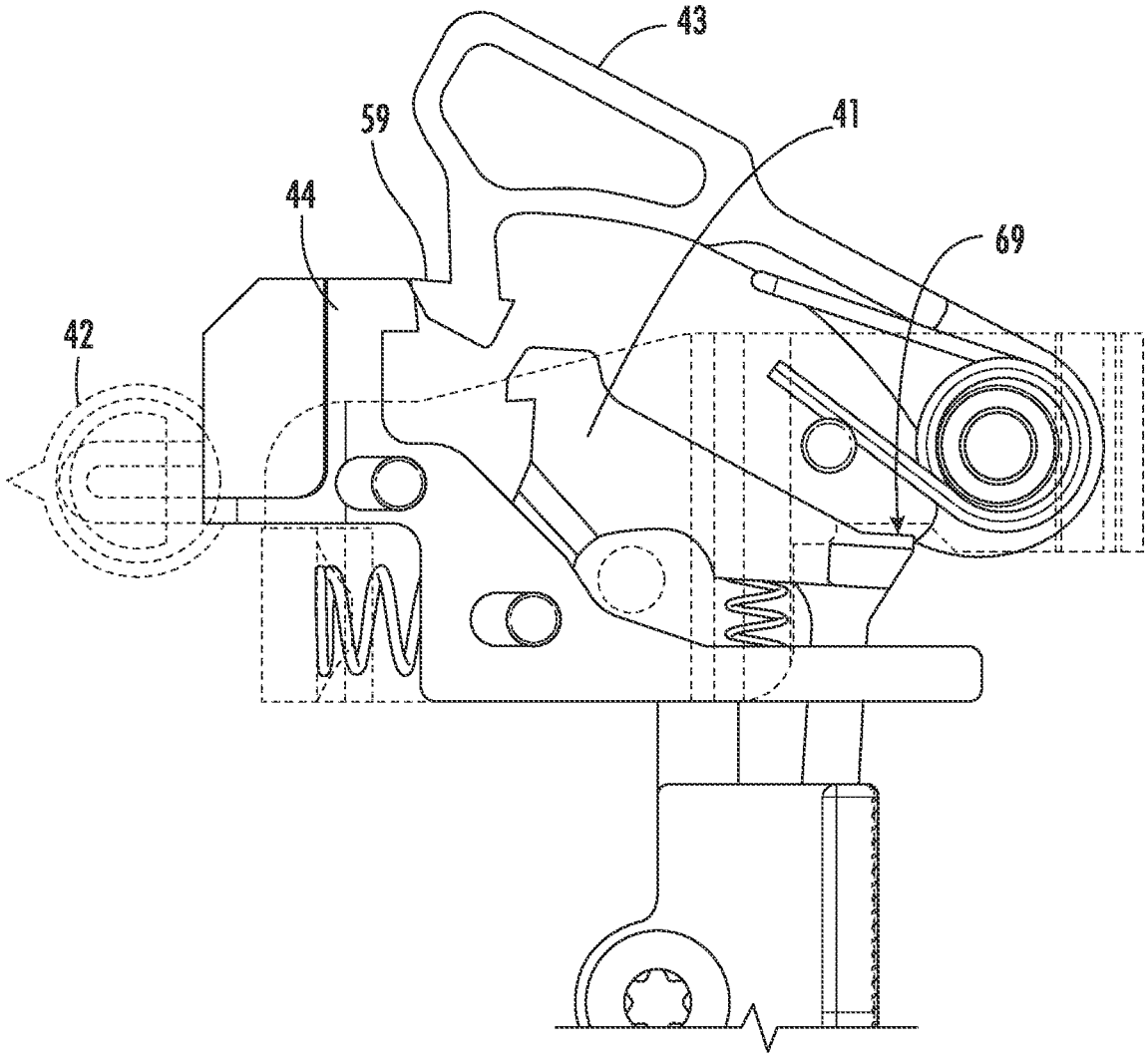
FIG. 27 is a partial side elevation view of a trigger assembly group arranged and configured in accordance with the teachings of the present disclosure.

FIG. 27 depicts the rear hammer catch 59 engaging the sloped front surface 70 of the primary trigger sear 61. While not fully depicted, the lower portion 75 of the secondary trigger 41 is being forced further into the channel 49 of the trigger shoe 45 due to the interaction between the forward hammer unlocking protrusion 66 and the secondary trigger unlocking protrusion 69, which interaction forces the locking wing members 53 further out of engagement with the upper locking housing grooves 71 and forces the locking wing members towards engagement with the lower housing grooves 65.

Figure 28:
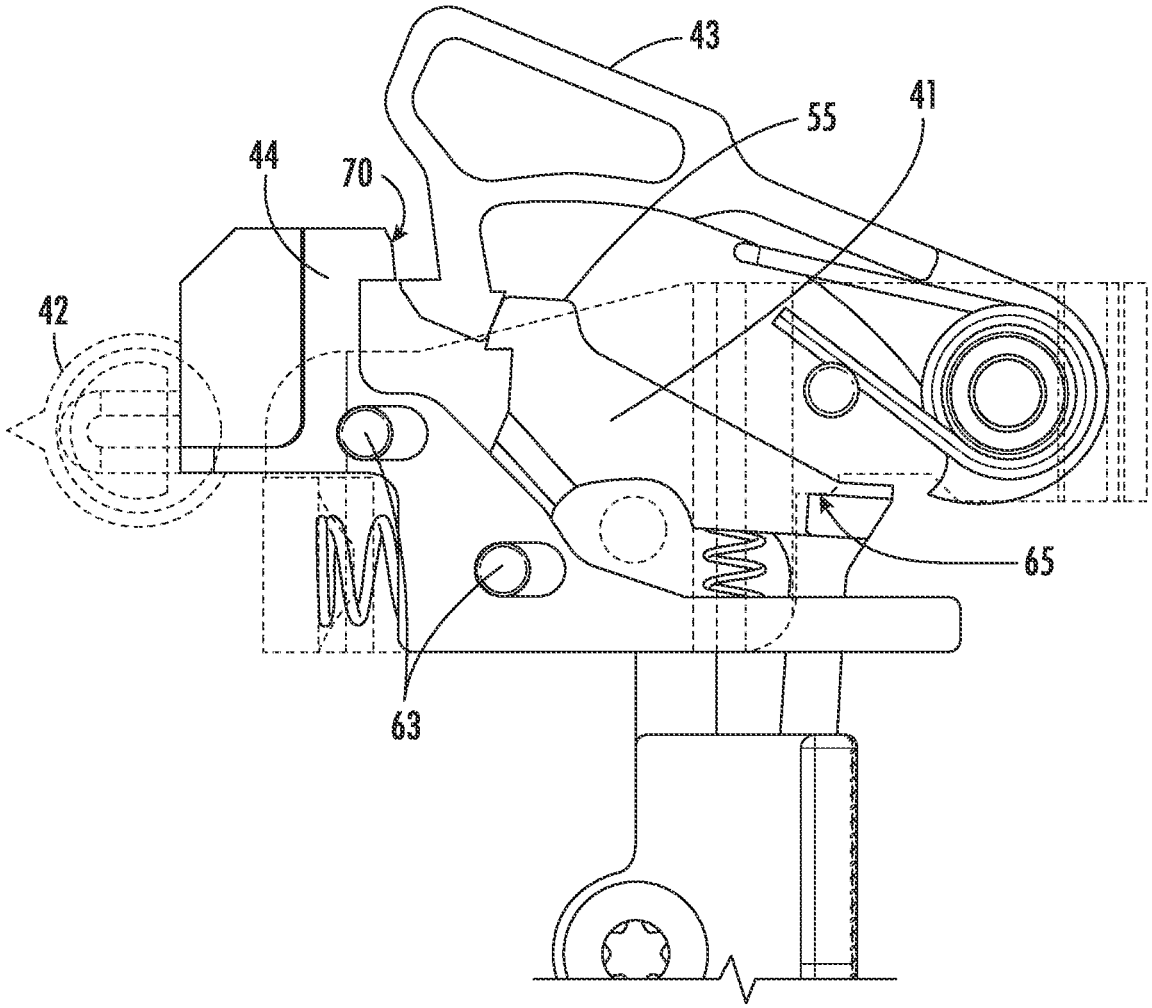
FIG. 28 is a partial side elevation view of a trigger assembly group arranged and configured in accordance with the teachings of the present disclosure.

FIG. 28 shows the trigger assembly group 40 in a rearmost position, as seen by the position of the retaining pins 63 in the linear retaining pin apertures 64. The interaction of the rear hammer catch 59 and the primary trigger sear 61 forces the trigger assembly group 40 to move linearly into a rearmost position. As depicted in FIG. 28, the locking wing members 53 are forced underneath the shoulders 72 of the housing 46 into the lower housing grooves 65. While not illustrated, in this step, the front face 52 of the lower portion of the secondary trigger 41 is fully retracted inside the channel 49 formed in the trigger shoe 45.

Figure 29:
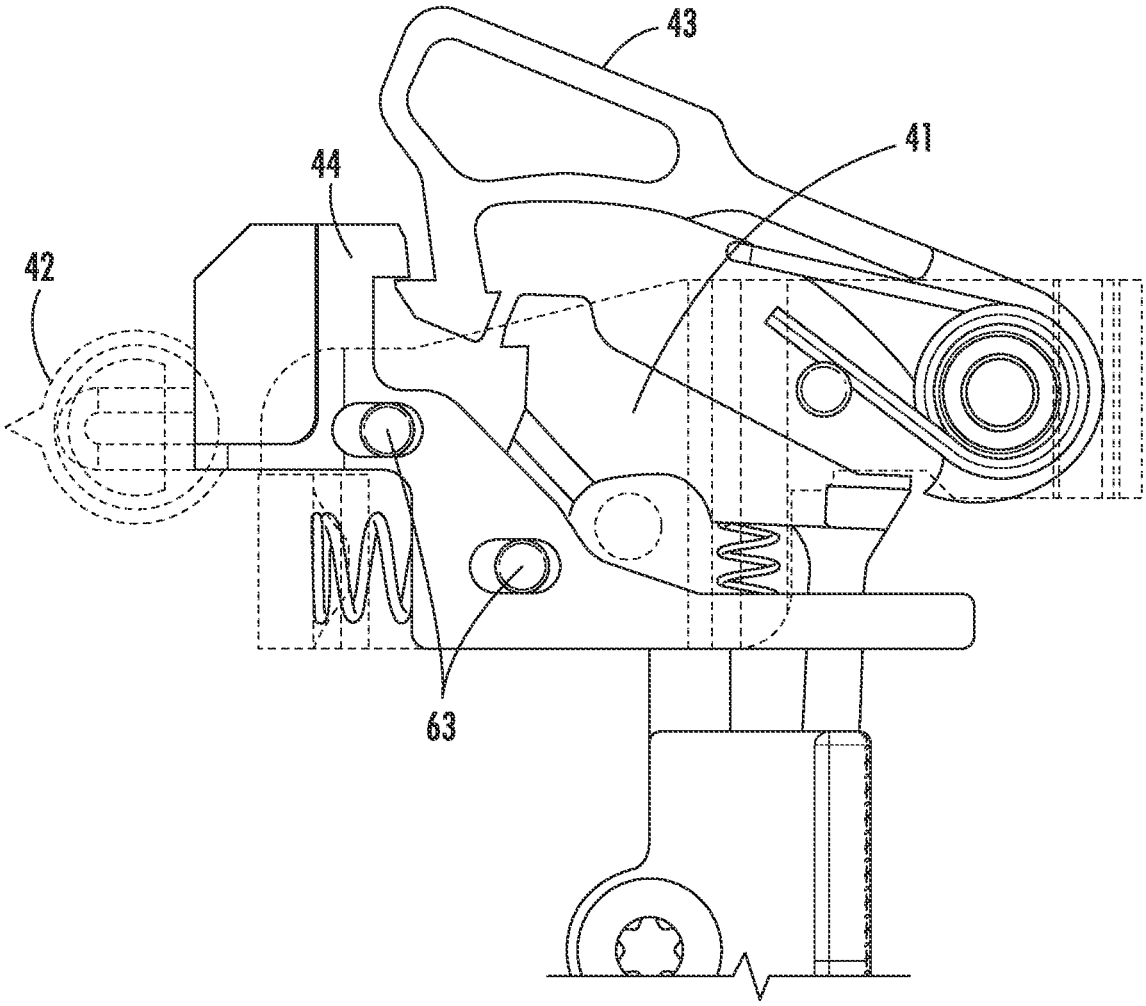
FIG. 29 is a partial side elevation view of a trigger assembly group arranged and configured in accordance with the teachings of the present disclosure.

Next, in FIG. 29, as the rear hammer catch 59 begins to engage the primary trigger sear 61, the primary trigger resilient member 50 begins forcing the trigger assembly group 40 forward (see the retaining pins 63 in the linear retaining pin apertures 64). As this occurs, the locking wings move out of engagement with the lower housing grooves 65 and engage the shoulders 72 of the housing 46.

Figure 30:
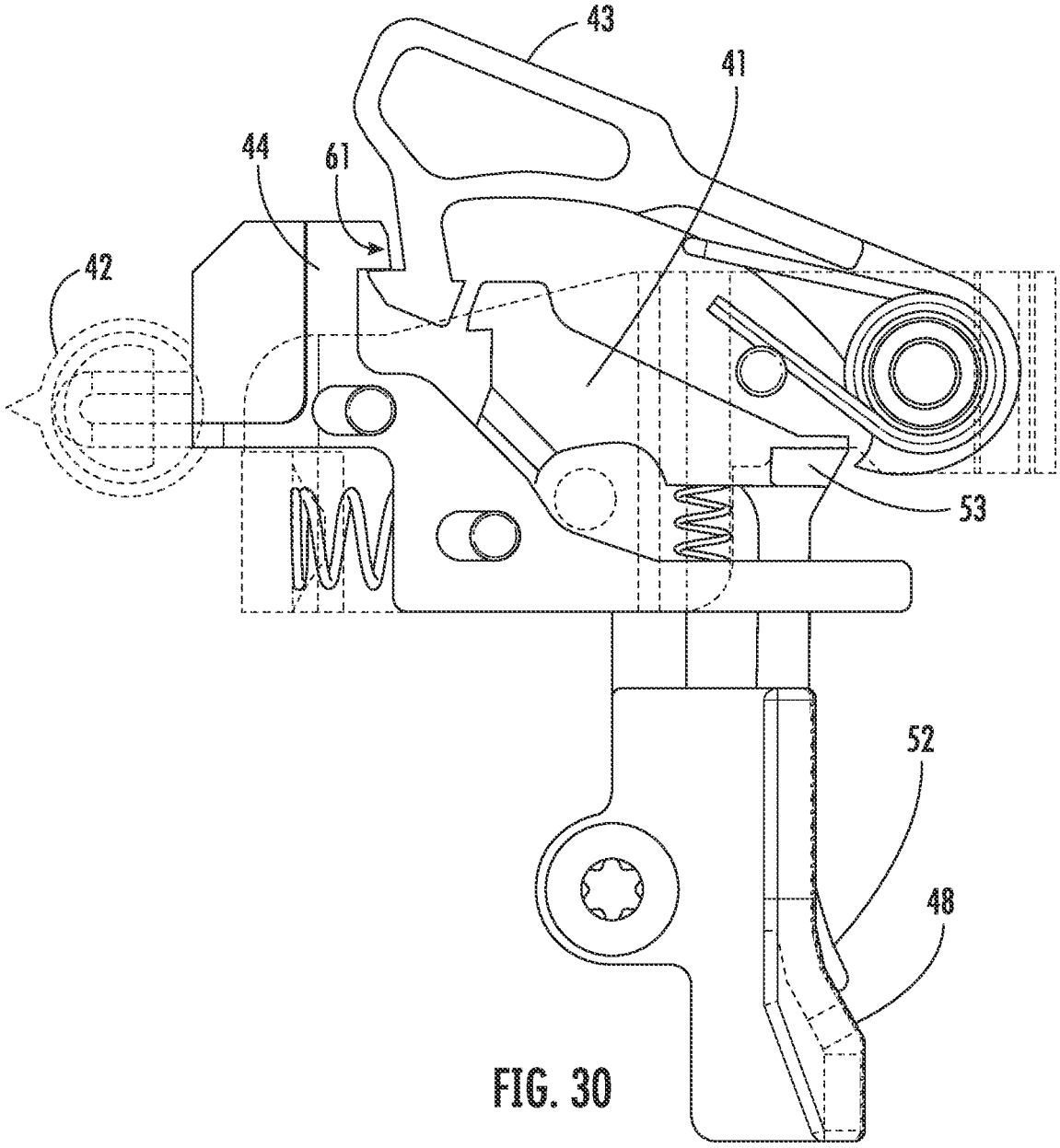
FIG. 30 is a side elevation view of a trigger assembly group arranged and configured in accordance with the teachings of the present disclosure.
Figure 31:
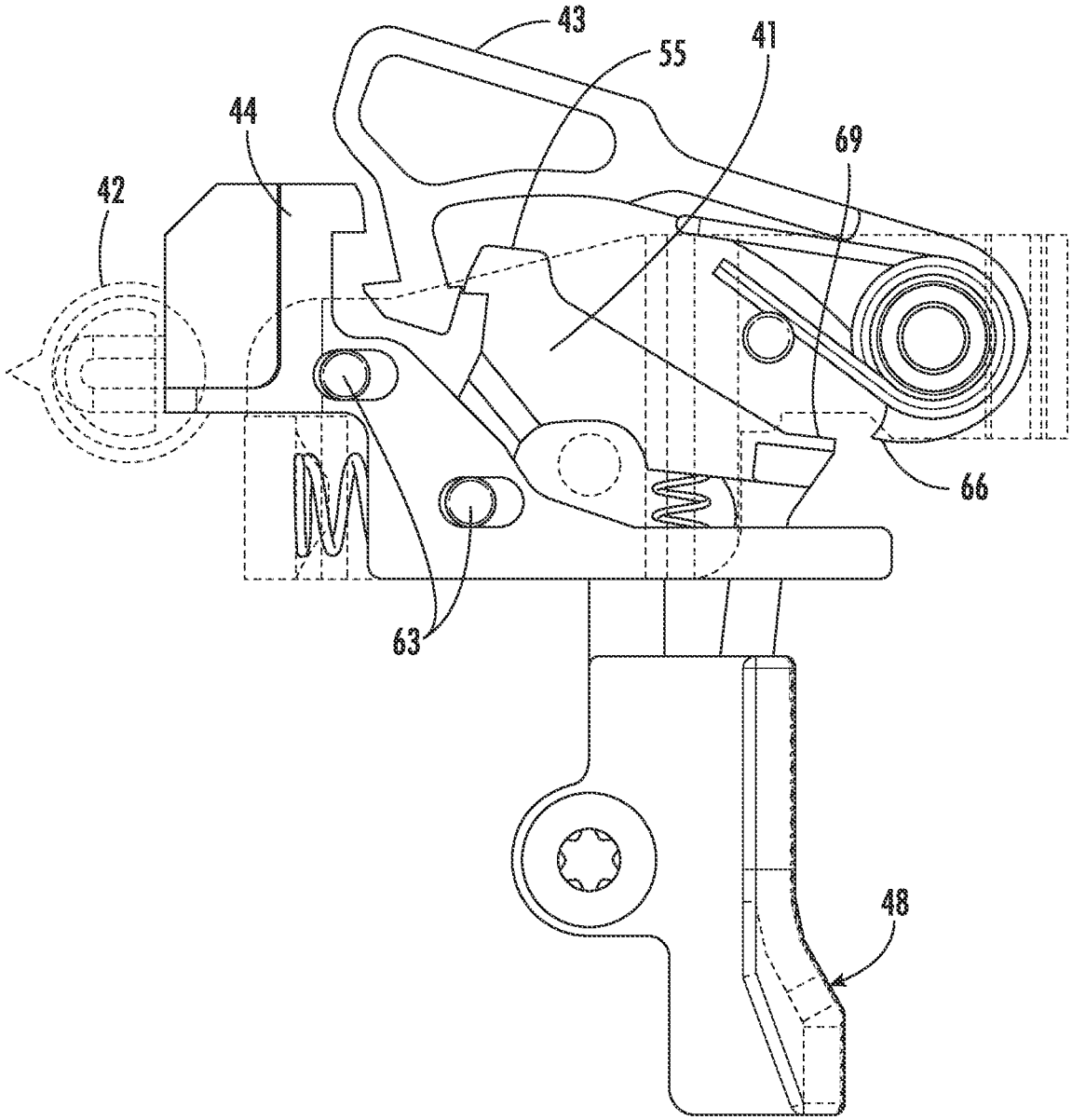
FIG. 31 is a side elevation view of a trigger assembly group arranged and configured in accordance with the teachings of the present disclosure.

Finally, in FIG. 30, the rear hammer catch 59 moves fully into engagement with the primary trigger sear 61 and the primary trigger resilient member 50 forces the trigger assembly group 40 back into its forwardmost position in the housing 46. The primary trigger sear 61 is arranged and configured to catch and retain the hammer 43 via the hammer's rear hammer catch 59. The secondary trigger resilient member 51 has forced the locking wing members 53 of the secondary trigger 41 back into engagement with the upper locking housing grooves 71 and into position against the shoulders 72 of the housing 46. The front face 52 of the lower portion of the secondary trigger 41 extends beyond the front face 48 of the shoe member. The hammer is cocked, the triggers are reset, and the firearm is ready to fire.

It is important to note that the construction and arrangement of the elements of the device provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes, and proportions of the various components, etc.) without materially departing from the novel teachings and advantages of the invention.

Many other uses of the present invention will become obvious to one skilled in the art upon acquiring a thorough understanding of the present invention. Once given the above disclosures, many other features, modifications, and variations will become apparent to the skilled artisan in view of the teachings set forth herein. Such other features, modifications and variations are, therefore, considered to be a part of this invention, the scope of which is to be determined by the following claims.

The invention claimed is:

1. A trigger assembly group for use in a firearm, comprising:

a housing;

a primary trigger connected to said housing;

a secondary trigger connected to said primary trigger and connected to said housing, said secondary trigger comprising a lower portion; and a trigger shoe connected to said primary trigger, said trigger shoe comprising a channel, wherein said channel is arranged and configured to receive said lower portion of said secondary trigger;

wherein said primary trigger and said secondary trigger are arranged and configured for linear movement relative to said housing.

2. The trigger assembly group of claim 1, further comprising a hammer connected to said housing.

3. The trigger assembly group of claim 2, wherein said hammer comprises a front hammer hook member, and wherein said secondary trigger comprises a disconnector head, said disconnector head being arranged and configured for temporarily engaging and disengaging said front hammer hook member when said firearm cycles.

4. The trigger assembly group of claim 2, wherein said hammer comprises a front hammer hook member, and wherein said trigger assembly group further comprises a disconnector head connected to said secondary trigger, said disconnector head being arranged and configured for temporarily engaging and disengaging said front hammer hook member when said firearm cycles.

5. The trigger assembly group of claim 2, wherein said secondary trigger further comprises a connecting member, said connecting member including an aperture therethrough for receiving a retaining pin that connects said secondary trigger to said primary trigger and to said housing.

6. The trigger assembly group of claim 2, wherein said secondary trigger further comprises a lower portion having a front face, wherein said front face of the lower portion of the secondary trigger is arranged and configured for engagement and pulling of the secondary trigger by a user's finger.

7. The trigger assembly group of claim 6, wherein said housing comprises upper locking housing grooves, lower housing grooves, and shoulders of the housing, said shoulders being positioned between said upper locking housing grooves and said lower housing grooves; and said secondary trigger comprises locking wing members, said locking wing members being arranged and configured for moving from engagement with said upper locking housing grooves to engagement with said lower housing grooves, said lower housing grooves being positioned underneath said shoulders of the housing.

8. The trigger assembly group of claim 7, wherein said secondary trigger further comprises an unlocking protrusion positioned between said locking wing members; and said hammer includes a forward hammer unlocking protrusion, for interacting with said unlocking protrusion of said secondary trigger;

wherein said forward hammer unlocking protrusion is arranged and configured to selectively force said unlocking protrusion of said secondary trigger in a downward direction upon engagement, thereby forcing said locking wing members out of engagement with said upper locking housing grooves and into engagement with said lower housing grooves.

9. The trigger assembly group of claim 1, wherein said housing further comprises one or more retaining pin apertures for receiving retaining pins, wherein said retaining pin apertures are configured for linear movement of said retaining pins in said retaining pin apertures, thereby providing for linear movement of said trigger assembly group in said housing.

10. The trigger assembly group of claim 2, wherein said primary trigger further comprises a primary trigger sear, said primary trigger sear being arranged and configured to engage and retain said hammer when said hammer is in a cocked position, and said primary trigger sear being arranged and configured to disengage from said hammer when said primary trigger and said secondary trigger are actuated rearwardly by a user to fire said firearm.

11. The trigger assembly group of claim 5, wherein said primary trigger further comprises a rear channel positioned for receiving said connecting member of said secondary trigger.

12. The trigger assembly group of claim 6, wherein said primary trigger further comprises a forward channel positioned for receiving said lower portion of said secondary trigger, wherein said lower portion of the secondary trigger is arranged and configured for engagement and pulling of the secondary trigger by a user's finger.

13. The trigger assembly group of claim 6, wherein said trigger shoe comprises:

a front face configured for engagement and pulling of said trigger shoe by a user's finger; and said channel formed in said trigger shoe being configured as a recess allowing said lower portion of the secondary trigger to move from extending outwardly in front of the front face of the trigger shoe, to withdrawing rearwardly until the front face of the lower portion of the secondary trigger is fully recessed within said channel formed in the trigger shoe.

14. The trigger assembly group of claim 10, wherein said hammer further comprises a rear hammer catch for engaging said primary trigger sear.

15. The trigger assembly group of claim 8, wherein said hammer further comprises an aperture for receiving a hammer pivot sleeve, said aperture being configured to further receive a trigger pack retaining bolt inserted through the hammer pivot sleeve.

16. The trigger assembly group of claim 8, wherein said hammer further comprises a resilient member arranged and configured to bias the hammer forward to strike a firing pin of a firearm when said primary trigger and said secondary trigger are pulled rearwardly, thereby releasing said hammer from engagement with said primary trigger sear.

17. The trigger assembly group of claim 2, further comprising a safety selector, wherein said safety selector can be adjusted between a safe position that prevents actuating said primary trigger and said secondary trigger, and a fire position that allows for actuation of said primary trigger and said secondary trigger to discharge the firearm.

18. The trigger assembly group of claim 1, wherein:

said housing further comprises retaining pin apertures for receiving retaining pins, said retaining pin apertures configured to allow rearward and forward linear movement of said retaining pins in said retaining pin apertures; said housing further comprising upper locking housing grooves and lower housing grooves;

said primary trigger further comprises a primary trigger sear;

said lower portion of said secondary trigger further comprises a front face arranged and configured for engagement and pulling of the secondary trigger by a user's finger;

said trigger shoe further comprising a front face arranged and configured for engagement and pulling of the trigger shoe by a user's finger; and said trigger assembly group further comprises a hammer connected to said housing, said hammer comprising a rear hammer catch;

wherein said primary trigger sear is arranged and configured for engagement of and disengagement from said rear hammer catch; and wherein actuating said primary trigger and said secondary trigger in a rearward linear direction disengages said primary trigger sear from said rear hammer catch, and discharges said firearm.

19. The trigger assembly group of claim 18, wherein said lower portion of said secondary trigger and said front face of said trigger shoe are actuated rearwardly until said locking wing members of said secondary trigger move out of engagement with said upper locking housing grooves and said locking wing members move into engagement with said lower housing grooves, and wherein said lower portion of said secondary trigger is receded within the front face of said trigger shoe such that the lower portion of the secondary trigger is no longer in contact with the user's finger.

20. The trigger assembly group of claim 19, further comprising a primary trigger resilient member disposed to force said primary trigger in a forward direction when said primary trigger resilient member is decompressed and disposed to allow said primary trigger to move in a rearward direction when said primary trigger resilient member is compressed; wherein said firearm comprises a bolt carrier group configured to force said hammer in a downward direction and back into a cocked position such that said rear hammer catch is in engagement with said primary trigger sear; wherein said hammer further comprises a front hammer hook member for temporarily engaging a disconnector head of said secondary trigger; wherein said primary trigger and said secondary trigger are disposed in a rearward position relative to said housing when said trigger shoe, said lower portion of said primary trigger, and said lower portion of said secondary trigger are actuated rearwardly by the user's finger, which decompresses said primary trigger resilient member.

21. The trigger assembly group of claim 20, wherein said disconnector head temporarily engages and holds said hammer in engagement with said disconnector head when said hammer is forced in a downward direction by a bolt carrier group until said front hammer hook member is forced below said disconnector head of said secondary trigger, thereby allowing said disconnector head to temporarily engage and hold said front hammer hook member in engagement with said disconnector head.

22. The trigger assembly group of claim 21, wherein when said primary trigger, said secondary trigger, and said trigger shoe are in a released position in which a user is not actuating said primary trigger and said secondary trigger rearwardly, and when said primary trigger resilient member is decompressed, said trigger assembly group is forced into a forwardmost position in said housing, thereby forcing said front hammer hook member to disengage from said disconnector head; wherein when said hammer is forced upwardly by a hammer resilient member, said rear hammer catch member engages with and is retained by said primary trigger sear; and wherein when a secondary trigger resilient member decompresses, said secondary trigger resilient member biases said locking wing members upwardly, thereby forcing said locking wing members into engagement with said upper locking housing grooves.

23. A trigger assembly group for use in a firearm, comprising:

a housing comprising upper locking housing grooves, lower housing grooves, and shoulders of said housing, said shoulders being positioned between said upper locking housing grooves and said lower housing grooves; said housing further comprising one or more retaining pin apertures for receiving retaining pins, wherein said retaining pin apertures are configured to allow for linear movement of said retaining pins in said retaining pin apertures, thereby providing for linear movement of a primary trigger and a secondary trigger in said housing;

said primary trigger connected to said housing, said primary trigger further comprising a primary trigger sear and a channel for receiving a secondary trigger;

said secondary trigger connected to said primary trigger and connected to said housing, said secondary trigger comprising a lower portion having a front face wherein said front face of the lower portion of the secondary trigger is arranged and configured for engagement and pulling of the secondary trigger by a user's finger; said secondary trigger further comprising a disconnector head; said secondary trigger further comprising locking wing members and an unlocking protrusion positioned between said locking wing members, said locking wing members being arranged and configured for moving from engagement with said upper locking housing grooves to engagement with said lower housing grooves, said lower housing grooves being positioned underneath said shoulders of the housing;

a trigger shoe connected to said primary trigger, said trigger shoe comprising a front face configured for engagement and pulling of said trigger shoe by a user's finger; said trigger shoe further comprising a channel, wherein said channel is arranged and configured to receive said lower portion of said secondary trigger; and a hammer connected to said housing, wherein said hammer comprises a front hammer hook member configured for transitory engagement with said disconnector head of the secondary trigger during cycling of the firearm; said hammer further comprising a rear hammer catch for engaging said primary trigger sear when said hammer is in a cocked position; said hammer further comprising a forward hammer unlocking protrusion for engaging with said secondary trigger unlocking protrusion, wherein said engagement of said forward hammer unlocking protrusion and said secondary trigger unlocking protrusion forces said locking wing members out of engagement with said upper locking housing grooves and into engagement with said lower housing grooves positioned underneath said shoulders of said housing; said hammer further comprising a resilient member arranged and configured to bias the hammer forward to strike a firing pin of a firearm when said primary trigger and said secondary trigger are actuated rearwardly, thereby releasing said hammer from engagement with said primary trigger sear;

wherein said primary trigger sear is arranged and configured to engage and retain said hammer when said hammer is in a cocked position, until said primary trigger and said secondary trigger are actuated rearwardly by a user to fire said firearm;

wherein said channel formed in said trigger shoe is configured as a recess allowing said lower portion of the secondary trigger to move from extending outwardly in front of the front face of the trigger shoe, to withdraw rearwardly until the front face of the lower portion of the secondary trigger is fully recessed within said channel formed in said trigger shoe;

wherein said disconnector head is arranged and configured for temporarily engaging and disengaging from said front hammer hook member when said firearm cycles from a released hammer position and back to a cocked hammer position;

wherein said forward hammer unlocking protrusion is arranged and configured to selectively force said unlocking protrusion of said secondary trigger in a downward direction, thereby forcing said locking wing members out of engagement with said upper locking housing grooves and into engagement with said lower housing grooves; and wherein said primary trigger and said secondary trigger are arranged and configured for linear movement in said housing.

24. A trigger assembly group for use in a firearm, comprising:

a housing comprising upper locking housing grooves and lower housing grooves;

said primary trigger connected to said housing, said primary trigger further comprising a primary trigger sear and a channel for receiving a secondary trigger;

said secondary trigger connected to said primary trigger and connected to said housing, said secondary trigger comprising a lower portion having a front face wherein said front face of the lower portion of the secondary trigger is arranged and configured for engagement and pulling of the secondary trigger by a user's finger; said secondary trigger further comprising a disconnector head; said secondary trigger further comprising locking wing members and an unlocking protrusion positioned between said locking wing members, said locking wing members being arranged and configured for moving from engagement with said upper locking housing grooves to engagement with said lower housing grooves;

a trigger shoe connected to said primary trigger, said trigger shoe comprising a front face configured for engagement and pulling of said trigger shoe by a user's finger; said trigger shoe further comprising a channel, wherein said channel is arranged and configured to receive said lower portion of said secondary trigger; and a hammer connected to said housing, wherein said hammer comprises a front hammer hook member configured for transitory engagement with said disconnector head of the secondary trigger during cycling of the firearm; said hammer further comprising a rear hammer catch configured to engage said primary trigger sear when said hammer is in a cocked position; said hammer further comprising a forward hammer unlocking protrusion configured to engage said secondary trigger unlocking protrusion, wherein said engagement of said forward hammer unlocking protrusion and said secondary trigger unlocking protrusion forces said locking wing members out of engagement with said upper locking housing grooves and into engagement with said lower housing grooves; said hammer further comprising a resilient member arranged and configured to bias the hammer forward to strike a firing pin of a firearm when said primary trigger and said secondary trigger are actuated rearwardly, thereby releasing said hammer from engagement with said primary trigger sear;

wherein said primary trigger sear is arranged and configured to engage and retain said hammer when said hammer is in a cocked position, until said primary trigger and said secondary trigger are actuated rearwardly by a user to fire said firearm;

wherein said channel formed in said trigger shoe is configured as a recess allowing said lower portion of the secondary trigger to move from extending outwardly in front of the front face of the trigger shoe, to withdraw rearwardly until the front face of the lower portion of the secondary trigger is fully recessed within said channel formed in said trigger shoe;

wherein said disconnector head is arranged and configured for temporarily engaging and disengaging from said front hammer hook member when said firearm cycles from a released hammer position and back to a cocked hammer position; and wherein said forward hammer unlocking protrusion is arranged and configured to selectively force said unlocking protrusion of said secondary trigger in a downward direction, thereby forcing said locking wing members out of engagement with said upper locking housing grooves and into engagement with said lower housing grooves.

* * * * *